US007656357B2

(12) United States Patent
Ishibashi et al.

(10) Patent No.: US 7,656,357 B2
(45) Date of Patent: Feb. 2, 2010

(54) TRANSPARENT ANTENNA FOR VEHICLE AND VEHICLE GLASS WITH ANTENNA

(75) Inventors: Tatsuo Ishibashi, Kyoto (JP); Shuzo Okumura, Kyoto (JP); Yuki Matsui, Kyoto (JP); Yoshitaka Yamaoka, Kyoto (JP)

(73) Assignee: Nissha Printing Co., Ltd., Kyoto (JP)

( * ) Notice: Subject to any disclaimer, the term of this patent is extended or adjusted under 35 U.S.C. 154(b) by 240 days.

(21) Appl. No.: 11/887,161

(22) PCT Filed: Mar. 29, 2006

(86) PCT No.: PCT/JP2006/306515

§ 371 (c)(1),
(2), (4) Date: Sep. 26, 2007

(87) PCT Pub. No.: WO2006/106759

PCT Pub. Date: Oct. 12, 2006

(65) Prior Publication Data

US 2009/0140938 A1 Jun. 4, 2009

(30) Foreign Application Priority Data

| | | |
|---|---|---|
| Apr. 1, 2005 | (JP) | 2005-106527 |
| Apr. 25, 2005 | (JP) | 2005-126895 |
| May 27, 2005 | (JP) | 2005-155120 |
| Jun. 1, 2005 | (JP) | 2005-162002 |

(51) Int. Cl.
*H01Q 1/32* (2006.01)
*H01Q 1/36* (2006.01)

(52) U.S. Cl. ..... 343/713; 343/897

(58) Field of Classification Search ..... 343/713, 343/897

See application file for complete search history.

(56) References Cited

U.S. PATENT DOCUMENTS

| | | | | |
|---|---|---|---|---|
| 6,384,790 | B2 | 5/2002 | Dishart et al. | |
| 6,933,891 | B2 * | 8/2005 | Lange | 343/700 MS |
| 2006/0152421 | A1 * | 7/2006 | Baranski | 343/713 |

FOREIGN PATENT DOCUMENTS

| | | |
|---|---|---|
| EP | 0 911 906 | 4/1999 |

(Continued)

OTHER PUBLICATIONS

International Search Report issued May 16, 2006 in the International (PCT) Application of which the present application is the U.S. National Stage.

(Continued)

*Primary Examiner*—Hoang V Nguyen
(74) *Attorney, Agent, or Firm*—Wenderoth, Lind & Ponack, L.L.P.

(57) ABSTRACT

A transparent antenna for a vehicle has a transmittance property providing good visibility without worsening the design and is capable of realizing low resistance. The transparent antenna has an insulating sheet-like transparent base body (1*a*) and an antenna pattern planarly formed on the surface of the transparent base body (1*a*). An electrically conductive section (1*b*) of the antenna pattern is constructed from an electrically conductive thin film of a mesh structure, lines of each mesh are constructed from very fine bands having substantially equal widths, and the width of each of the very fine bands is 30 μm or less. The light transmittance of the antenna pattern is 70% or higher.

9 Claims, 21 Drawing Sheets

FOREIGN PATENT DOCUMENTS

| | | |
|---|---|---|
| EP | 1 508 938 | 2/2005 |
| JP | 64-49302 | 2/1989 |
| JP | 2-256304 | 10/1990 |
| JP | 3-39911 | 4/1991 |
| JP | 2000-124730 | 4/2000 |
| JP | 2000-138512 | 5/2000 |
| JP | 2000-341020 | 12/2000 |
| JP | 2001-196826 | 7/2001 |
| JP | 2001-274611 | 10/2001 |
| JP | 2002-518920 | 6/2002 |
| JP | 2003-090903 | 3/2003 |
| JP | 2003-258483 | 9/2003 |
| JP | 2005-64174 | 3/2005 |
| JP | 2005-142984 | 6/2005 |
| WO | 2004/084346 | 9/2004 |

OTHER PUBLICATIONS

International Preliminary Report on Patentability issued in PCT/JP2006/306515, with Form PCT/IB/373, and Form PCT/ISA/237, date of issuance Oct. 3, 2007.

Informal Comments filed Jul. 7, 2006 in International PCT/JP2006/306515, of which the present application is the U.S. national stage.

European Search Report issued Jul. 14, 2009 in EP Application 06 73 0905, which is a counterpart to the present application.

European Search Report issued Jul. 15, 2009 in EP Application 06 73 0905, which is a counterpart to the present application.

* cited by examiner the attaching object side

TRANSPARENT ANTENNA FOR VEHICLE AND VEHICLE GLASS WITH ANTENNA

This application is a 371 of PCT/JP2006/306515 dated Mar. 29, 2006.

TECHNICAL FIELD

The present invention relates to a transparent antenna for a vehicle to be installed to a glass face of a vehicle for receiving ground-based broadcasting and satellite-based broadcasting or transmitting and receiving radio waves, and vehicle glass with an antenna.

BACKGROUND ART

Conventionally, various film antennas to be used while being installed to a glass face of an automobile have been proposed with the popularization of car navigation systems.

A film antenna is attached to a fixed glass face. However, since heating lines for a defogger are generally wired in rear glass, the film antenna is often attached to front glass to avoid interference with the heating lines.

As this kind of film antenna, there have been proposed (a) those which are obtained by forming an antenna pattern with a metal thin wire on a transparent plastic film with electrical isolation, and (b) those which have transparency by forming a large number of fine holes on a metal foil to be an antenna by punching or the like.

However, the film antennas described in (a) have a problem that the bent metal thin wire is seen outstandingly from the inside or the outside of an automobile to not only worsen the design but also become an obstacle in driver's visibility, because of the configuration of bending and curving the wire in the antenna shape and sticking the metal thin wire to a transparent plastic film.

Further, the film antenna described in (b) is seen more outstandingly as compared with the film antenna described in (a) since a large number of holes are formed on a metal foil by punching. Moreover, whether the design of the antenna is good or bad depends on the punching accuracy of the punched holes.

If an antenna pattern is constructed from a transparent electrically conductive film used for a touch panel or the like, it is expected that an excellent design and a good driver's visibility can be assured as compared with the film antennas described in (a) and (b).

However, the transparent electrically conductive film has a characteristic that as the film thickness is made thinner and the transparency is increased more, the surface resistance, which is a measure of the conductivity, is increased more and it is therefore difficult to provide the transparency required for front glass and low resistance required for the antenna.

Incidentally, the resistance of a transparent electrically conductive film whose transparency is assured has a resistance of several tens to several hundreds Ω, meanwhile the resistance required for the antenna has to be a value as low as 3Ω or lower.

The present invention has been accomplished in consideration of the above-mentioned problems of conventional film antennas and an object of the present invention is to provide a transparent antenna for a vehicle having transparency for giving a good driver's visibility without worsening the design of the antenna and capable of realizing low resistance required for the antenna as well as vehicle glass with an antenna.

SUMMARY OF THE INVENTION

The present invention provides a transparent antenna for a vehicle, which has a sheet-like transparent substrate with an electrical isolation and an antenna pattern planarly formed on the surface of the transparent substrate. An electrically conductive part of the antenna pattern is constructed from an electrically conductive thin film of a mesh structure, and outlines of each mesh are constructed from extra fine bands having substantially equal widths, and the width of each of the extra fine bands is 30 μm or less and the light transparency of the above-mentioned antenna pattern formation section is 70% or higher.

In the present invention, the above-mentioned mesh structure is constructed from planar meshes regularly continuous on a plane with the same shape and size and if a distinguishing pattern is added linearly in a plurality of meshes or in bands-like state to a plurality of mesh lines, since the light quantity passing through these meshes is damped to be less than the light quantity passing through the above-mentioned antenna pattern, the above-mentioned distinguishing pattern can be made outstanding from the antenna pattern.

The above-mentioned distinguishing pattern can be formed by making the outlines of the meshes composing the above-mentioned planar meshes wide bands or by shifting a mesh pattern being a part of the mesh structure on the mesh structure within a range not exceeding each mesh size and superposing the mesh pattern on the antenna pattern. If such a distinguishing pattern is continuously or intermittently formed on the antenna pattern, letters and designs can be formed on the transparent antenna face.

In the present invention, the above-mentioned mesh structure is constructed from regularly continued planar meshes on a plane and at the same time, a gradation section may be formed in the boundary region of the antenna pattern and the antenna pattern non-formation section in the transparent substrate for decreasing brightness difference between the antenna pattern and an antenna pattern non-formation section.

The above-mentioned gradation section can be formed by partially eliminating the mesh lines of the antenna pattern in the above-mentioned boundary region or coarsening the meshes.

Further, the above-mentioned gradation section can be formed by making the elimination width of the above-mentioned mesh lines or the aperture width of the meshes longer step by step from the antenna pattern side to the antenna pattern non-formation section side.

Further, the above-mentioned gradation section can be formed also by constructing the mesh structure by arranging vertical electrically conductive wires and transverse electrically conductive wires in a lattice like state, eliminating parts of at least one of the vertical electrically conductive wires and transverse electrically conductive wires or widening the intervals of neighboring electrically conductive wires from the antenna pattern side to the antenna pattern non-formation section side.

In the present invention, the above-mentioned antenna pattern can be formed in a continuous band-like shape by partially slitting the mesh structure. In this case, however the widths of the slits is controlled not to exceed the maximum mesh size.

The above-mentioned antenna pattern can be formed in a meandering shape by alternately forming a plurality of slits with a prescribed length for the mesh structure in different directions. The antenna pattern can be formed by forming one slit spirally toward the center of the above-mentioned mesh structure. The maximum size of the above-mentioned meshes is preferably 1 mm.

In the above-mentioned transparent antenna for a vehicle, the shape of the above-mentioned meshes may be constructed to be geometric designs.

However, in the case where the lines of the meshes do not form geometric designs of extra fine bands, for example, in a case where a large number of circular holes are formed on a sheet face, even if the circular holes are arranged at the maximum density, wide width parts are formed between neighboring circular holes, and not only the wide width portion are made outstandingly visible, but also the light transmittance is decreased. Accordingly, the present invention excludes those of geometric designs in which the lines of the meshes are not constructed from extra fine bands even if the antenna pattern has geometric designs such as circles and ellipses.

Further, the above-mentioned antenna pattern can be constructed from a very thin metal wire made of copper or a copper alloy.

Further, it is preferable to form a transparent protection film on the surface of the above-mentioned antenna pattern.

Further, it is preferable to install electrodes for electric power supply in a part of the above-mentioned electrically conductive section and expose the electrodes by forming a through hole section in the transparent protection film corresponding to the electrodes.

It is also preferable to carry out low-reflection treatment on the surface of the above-mentioned extra fine bands.

Further, a transparent adhesive layer can be formed on a face opposite the electrically conductive section formation side of the above-mentioned transparent substrate.

The transparent antenna for a vehicle with the above-mentioned configuration of the present invention is provided with transparency, giving good driver's visibility, and capable of realizing low resistance required for an antenna.

The vehicle glass with an antenna of the present invention is obtained by embedding the transparent antenna for a vehicle, equipped with electrodes for electric power supply in a part of the above-mentioned electrically conductive section and having the above-mentioned configuration, in a bonding face of laminated glass in a state in which the electrodes are projected outside.

According to the above-mentioned vehicle glass with an antenna, since a transparent antenna can be embedded in the bonding face of two glass sheets in a laminated glass production process, unlike the case of disposing an antenna later, no step corresponding to the transparent antenna thickness is formed on the front glass surface and the design can be improved. Further, embedding the transparent antenna in the laminated glass makes it possible to stably maintain the antenna capability.

DETAILED DESCRIPTION OF THE INVENTION

Hereinafter, the present invention will be described in more detail with reference to the embodiments shown in drawings.

(a) First Embodiment of the Invention

A transparent antenna for a vehicle (hereinafter, referred to as a transparent antenna for short) of a first embodiment is made to have transparency giving good driver's visibility and capable of realizing low resistance.

Figure 1:
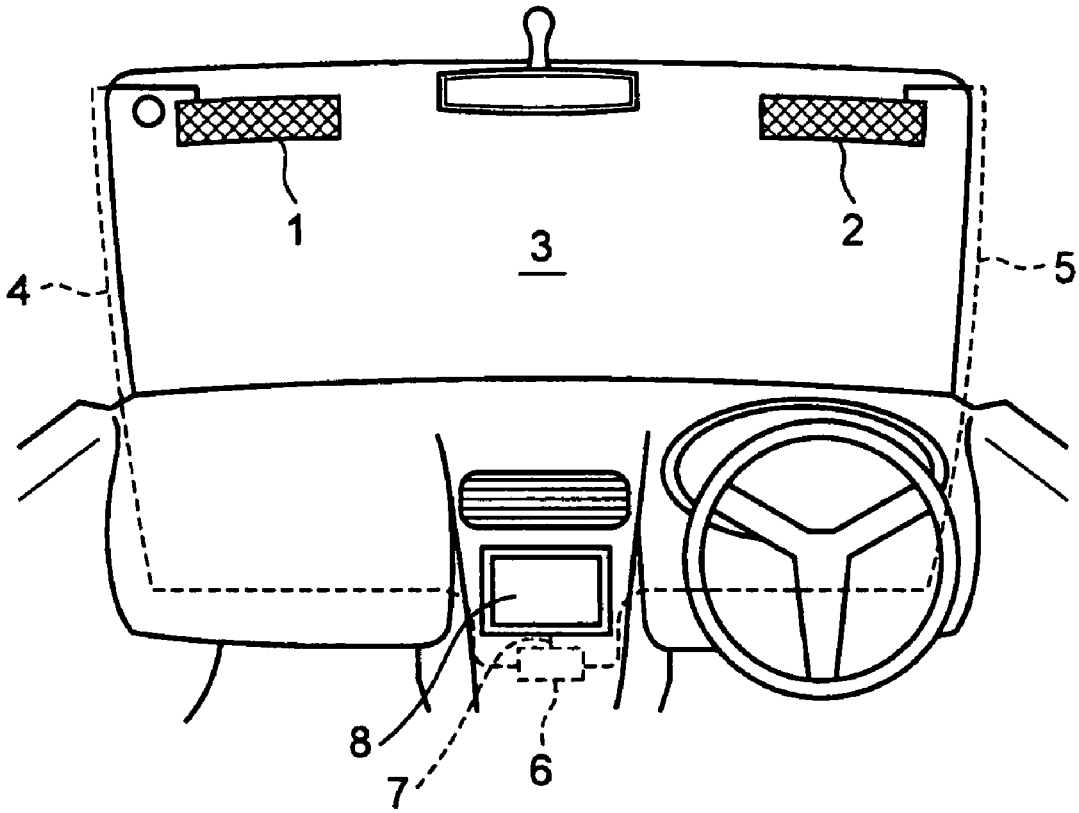
FIG. 1 is a front view showing the use state of a transparent antenna of a first embodiment of the present invention.

FIG. 1 shows the state that the above-mentioned transparent antenna is attached to front glass of an automobile.

In this drawing, transparent antennas 1 and 2 are installed in the upper parts of both right and left sides of front glass 3.

An antenna cord 4 is connected to the transparent antenna 1 in the left side and an antenna cord 5 is connected to the transparent antenna 2 in the right side and output terminals of the respective antenna cords 4 and 5 are connected to an amplifier unit 6 and an antenna output cord 7 led out of the amplifier unit 6 is connected to a TV tuner disposed in a monitor 8 of a car navigation system.

Figure 2:
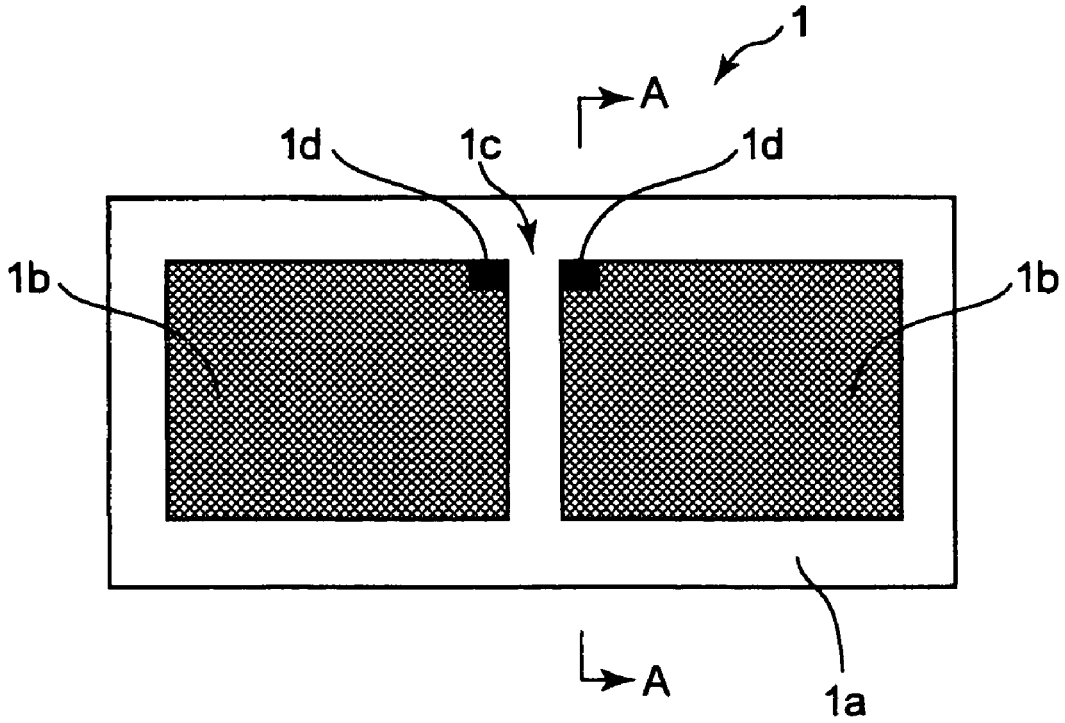
FIG. 2 is an enlarged view of the transparent antenna shown in FIG. 1.

FIG. 2 shows an enlarged view of the transparent antenna 1. The transparent antenna 2 has the same configuration as that of the transparent antenna 1, and therefore, its explanation is omitted.

In FIG. 2, the transparent antenna 1 comprises a transparent plastic sheet 1*a* as transparent substrate with electrical isolation, and a planar antenna pattern of an electrically conductive section 1*b* formed thereon. Further, a pair of electrodes 1*d* are set face to face across a gap 1*c* between two antenna patterns formed in a transversely elongated rectangular shape.

As the above-mentioned transparent plastic sheet 1*a*, transparent resin films of polycarbonates, acrylic polymers, polyethylene terephthalate, and triacetyl cellulose, can be used, and also sheet-like transparent glass can be used.

The electrically conductive section 1*b* is formed in a planar state on approximately the entire face of the transparent plastic sheet 1*a*, unlike an electrically conductive section formed by bending an electrically conductive wire material or a thin band in a case of a conventional antenna pattern.

The above-mentioned electrically conductive section 1*b* is constructed from an electrically conductive thin film with a mesh structure and has a fine mesh-like pattern constructed from a metal film of copper, nickel, aluminum, gold, silver, or the like, or an electrically conductive paste film containing metal fine particles of these metals, or a carbon paste film by photoetching of the metal thin film formed on the transparent plastic sheet 1*a*, or etching using printing resist, or printing an electrically conductive resin paste.

In the case where the above-mentioned antenna pattern is formed by photoetching, a photoresist film is formed on a metal film, exposed using a photo-mask, and developed using a development solution to form an antenna pattern of the resist film. Further, etching is carried out by an etching solution and the resist film is peeled and removed to form the antenna pattern with a extra fine metal wire.

Further, in the case of formation by printing resist, an antenna pattern of a resist film is printed on a metal film by screen printing, gravure printing, ink-jet method, or the like; etching the metal film other than the resist-coated part of the metal film by an etching solution, and peeling the resist film to form an antenna pattern of the metal thin film.

In the case of formation by electrically conductive paste printing, an antenna pattern is printed on a transparent substrate with an electrically conductive paste containing metal fine particles, a carbon paste, or the like to form an electrically conductive antenna pattern.

Additionally, if the surface of the extra fine metal wire formed in a mesh-like pattern is subjected to low-reflection treatment, the reflection color of the metal is suppressed to make the existence of the transparent antenna 1 hardly noticeable. Accordingly, the visibility is improved for seeing outside of a vehicle through the mesh-like pattern.

Practical examples of the above-mentioned low-reflection treatment may be surface treatment such as chemical conversion treatment, plating treatment, or the like. The chemical conversion treatment is for forming a low reflectance layer on the metal surface by oxidation treatment or sulfurization treatment and for example, in the case of using copper as a material for the extra fine metal wire, if an oxide coating is formed on the surface by oxidation treatment, the surface of the extra fine metal wire is turned to be black with a light reflection preventive property without decreasing the cross-sectional size of the extra fine metal wire.

Further, if black chromium plating is carried out as plating treatment to the extra fine metal wire, the surface of the extra fine metal wire is turned to be black with an antireflection property. Further, if copper plating is carried out at a high current density, the wire can be turned to be brown.

The above-mentioned electrode sections 1*d* are for attaching electric power supply parts (not shown) of the antenna cord 4, and the electrode parts 1*d* are constructed from square sheets electrically connected with the mesh-like pattern.

Figure 3:
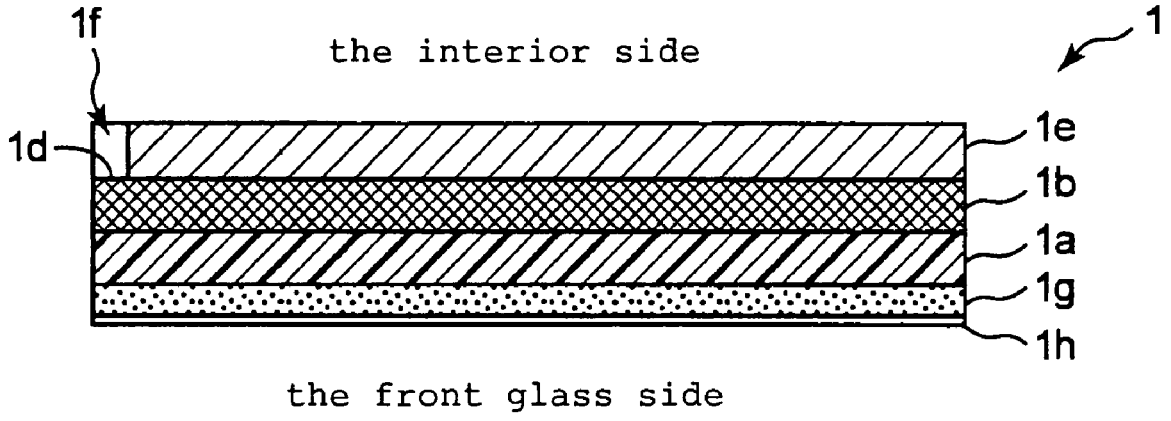
FIG. 3 is a cross-sectional view along the line A-A in FIG. 2.

FIG. 3 is a cross-sectional view along the line A-A in FIG. 2.

An electrically conductive section 1*b* is formed on a transparent plastic sheet 1*a* and the electrically conductive section 1*b* is further covered with a transparent cover layer (a transparent protection film) 1*e*. In this manner, the electrically conductive section 1*b* is protected with the transparent cover layer 1*e*, so that it is made possible to keep stable antenna performance even if the environment, e.g. temperature or humidity, of a vehicle in which the transparent antenna 1 is disposed, is changed.

A method for forming the above-mentioned transparent cover layer 1*e* may include forming by sticking a transparent film to an antenna pattern of the electrically conductive section 1*b* using a transparent adhesive or pressure sensitive adhesive or by applying a transparent resin in a prescribed thickness to the antenna pattern.

A through hole section if is formed in a part of the transparent cover layer 1*e* and the electrode parts 1*d* are exposed to the through hole section 1*f*. The above-mentioned electric power supply parts of the antenna cord 4 are stuck to the exposed electrode parts 1*d*.

A transparent pressure sensitive layer 1*g* is formed on a face opposite the electrically conductive sections 1*b* of the transparent plastic sheet 1*a* and a separating sheet 1*h* is formed on the surface of the transparent pressure sensitive layer 1*g*.

As the transparent pressure sensitive layer 1*g*, those without worsening the transparency of the antenna, for example, acrylic type pressure sensitive adhesive materials to be used as glue materials for smoky films which are stuck to front glass of automobiles for decreasing ultraviolet rays.

In the case where the transparent antenna 1 is to be stuck to front glass later, the above-mentioned separating sheet 1*h* is peeled to expose the transparent pressure sensitive adhesive layer 1*g* and the transparent antenna 1 is stuck to the front glass through the transparent pressure sensitive adhesive layer 1*g*. That is, in the case of the transparent antenna 1 shown in FIG. 3, the top face is set toward the interior side and the bottom face is set in the front glass side.

Without being limited to attach to the front glass as an extra part, the above-mentioned transparent antenna 1 may be embedded previously in the front glass.

In the case where laminated glass is used as the front glass, the transparent antenna 1 can be sandwiched between two glass sheets in a front glass manufacturing process. In this case, since the transparent antenna 1 is integrated with laminated glass, formation of the transparent pressure sensitive adhesive layer 1*g* is not necessarily needed. The transparent cover layer 1*e* may be formed based on the necessity.

Figure 4:
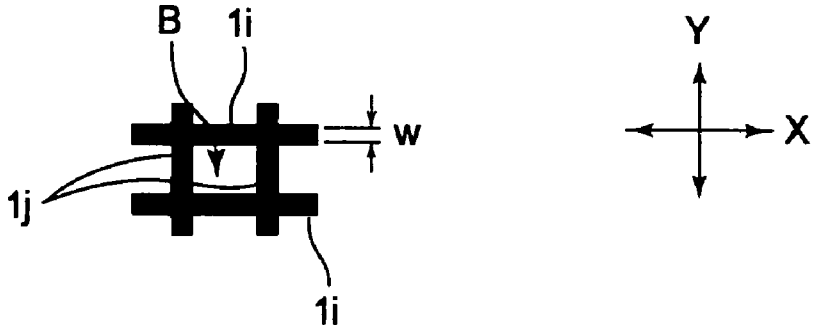
FIG. 4 is an enlarged view of a main part showing a basic pattern of an extra fine metal wire composing an electrically conductive section of FIG. 2.

FIG. 4 is an enlarged view of a part of the above-mentioned antenna pattern for showing the meshes.

The antenna pattern shown in FIG. 4 is formed in lattice type meshes of straight electrically conductive sections 1*i* and 1*j* extended in the X-direction and the Y-direction and is enabled to have 70% or higher light transmittance for the transparent antenna 1.

The above-mentioned light transmittance, which is a gauge of the transparency, means the total light transmittance for the total quantity of the light having entire wavelength emitted from a light source having a specified color temperature and transmitted through a sample face. If the light transmittance is lower than 70%, difference between the light transmittance of the front glass and the light transmittance of the transparent antenna 1 becomes wide to make the antenna pattern of the transparent antenna 1 appear dark. Therefore, the existence of the antenna becomes an obstacle. If it interferes in the driver's visibility of the front glass, safety is diminished.

The above-mentioned light transmittance is measured using a spectroscopic analyzer (model number NDH 2000) manufactured by Nippon Denshoku Industries Co., Ltd. However, the light transmittance of 100% in an air layer is defined as the standard.

In the case where the transparent cover layer 1*e* is formed in the transparent antenna 1, the measurement of the light transmittance is carried out in the state that the transparent cover layer 1*e* is included and in the case where the transparent pressure sensitive adhesive layer 1*g* is formed, the measurement is carried out in the state that the transparent pressure sensitive adhesive layer 1*g* is included.

Further, the wire widths w of the extra fine metal wire (extra fine band) 1*i* in the X-direction and the extra fine metal wire (extra fine band) 1*j* in the Y-direction forming square-shaped outlines are adjusted to be respectively 30 μm or thinner in a uniform width. If the wire width w is thicker than 30 μm, the meshes of the antenna pattern become outstandingly visible and the design is worsened. If the wire width w is 30 μm or thinner, the existence of the antenna pattern is hardly recognized. If the film thickness of the extra fine metal wire is adjusted to give 0.5 or higher aspect ratio of the wire width/film thickness t, it becomes easy to produce the antenna pattern with high precision.

In the present embodiment, the light transmittance of the transparent antenna 1 is made to keep light transmittance of 70% or higher by selecting combinations of the wire width of the above-mentioned extra fine metal wires 1*i* and 1*j* and the size of the aperture part B formed by being surrounded with these extra fine metal wires 1*i* and 1*j*.

Figure 5:
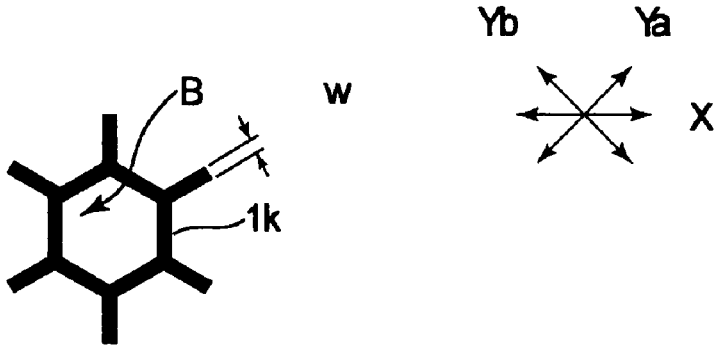
FIG. 5 is a view equivalent to FIG. 4 showing a modified example of the antenna pattern.
Figure 6:
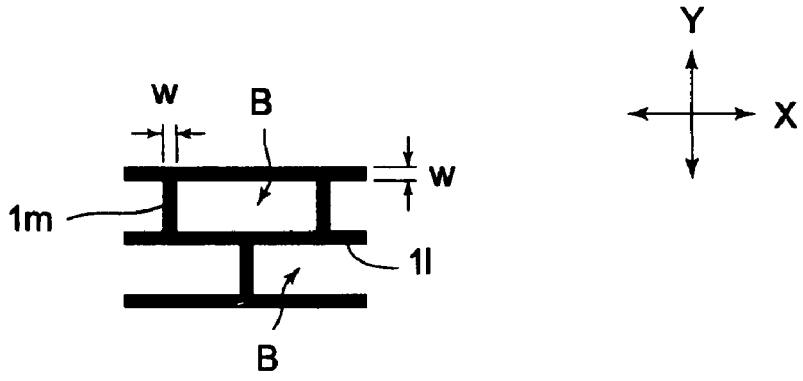
FIG. 6 is a view equivalent to FIG. 4 showing another modified example of the antenna pattern.

FIG. 5 and FIG. 6 show modified examples of antenna patterns.

The antenna pattern shown in FIG. 5 is made to be a mesh-like shape having a hexagonal shape as a core and continuous in the X-direction, the Ya-direction, and the Yb-direction.

The wire width w of the extra fine metal wire 1*k* forming the outlines of the hexagon is 30 μm or thinner.

The antenna pattern shown in FIG. 6 is made to be a mesh-like shape having a ladder shape as a core and continuous in the X-direction and the Y-direction. The wire widths w of the extra fine metal wires 1*l* and 1*m* forming the outlines of the ladder shape are respectively 30 μm or thinner.

As described, the antenna pattern may include those having continuous rectangular shapes as a core, those having continuous polygonal shapes as a core, and those having continuous ladder shapes as a core.

Among them, those having continuous square shapes as a core are particularly preferable since it becomes hard to recognize the antenna pattern as stripes as compared with other polygonal shapes.

That is, when a pattern regularly continuing a certain shape as a core is seen, the lines tends to be seen in stripes continuous along the continuing cores (apertures). For example, in the case where a hexagonal shape forms the core, the lines of the above-mentioned extra fine bands along the continuous directions become zigzag and accordingly the lines appear to be thick to the extent corresponding to the fluctuation of the zigzag shape and as a result, the extra fine bands are seen in an expanded state. On the other hand, in the case of those having the above-mentioned square shapes as a core, since the lines of the extra fine bands along the continuous directions become straight, there is no probability that the lines are seen thicker than the actual width and as described above, the extra fine bands are so extremely thin as 30 μm or thinner and thus the existence is hardly recognized and the antenna pattern is not seen outstandingly.

In the case of those having continuous rectangular shapes as a core, since the pitches in the longer side direction and the shorter side direction of the rectangular shape differ and therefore, if the entire body is observed, the lines are seen darker in the shorter side direction in which the pitches are shorter than in the longer side direction and they tend to be blinkingly seen just like stripes, meanwhile in the case of those having the above-mentioned square shapes as a core, such stripes do not appear and are not seen outstandingly.

The above-mentioned square shapes may include not only complete squares having stiff corners but also chamfered squares.

EXAMPLE 1

A copper foil with a thickness of 12 μm and subjected to low-reflection treatment in both faces was stuck to a transparent polyethylene terephthalate film with a thickness of 100 μm with a transparent adhesive and an antenna pattern was produced by photoetching.

The electrically conductive section was formed to be a square mesh pattern with a line width of 15 μm and line space pitches of 700 μm.

Next, a transparent polyethylene terephthalate cover film (a cover layer) with a thickness of 50 μm was formed on the face of the electrically conductive section having the antenna pattern by an acrylic type transparent adhesive. The electrode sections were exposed from the aperture parts which were formed by cutting a part of the cover film.

A both side-coated transparent acrylic type pressure sensitive film with a separating sheet for sticking the transparent antenna 1 to front glass is stuck to a face (rear face) opposite the electrically conductive section of the transparent polyethylene terephthalate film.

The laminate body, in which the antenna pattern was formed on the transparent polyethylene terephthalate film and then covered with the cover film, and the both side-coated transparent acrylic type pressure sensitive film with a separating sheet was stuck to the rear face of the transparent polyethylene terephthalate film, was cut in the outside along the antenna pattern to produce a transparent antenna 1.

The transparent antenna 1 produced in this manner had a light transmittance of 84%.

Two sheets of this transparent antenna 1 were prepared and the respective separating sheets were peeled off and the sheets were stuck to the right and left upper parts of front glass of an automobile.

With respect to the stuck transparent antennas 1, the existence of the antenna patterns could be scarcely recognized when being seen from the driver's sheet side and an assistant driver's sheet side and does not interfere with the driver's visibility.

Next, when an antenna cord was connected to these transparent antennas 1 and the antenna cord was connected to a TV tuner of a car navigation system to receive television broadcasting, a good reception state could be obtained.

EXAMPLE 2

An antenna pattern was produced on a transparent polycarbonate film with a thickness of 100 μm by screen printing using silver paste. The electrically conductive section was made to have a hexagonal mesh pattern with line width of 30 μm and line space pitches of 700 μm in X-direction.

Next, the outside was cut along the produced antenna pattern to produce a transparent antenna 1.

The transparent antenna 1 was sandwiched in a production process of laminated glass for automotive front glass while the electrode sections 1*d* are projected out of the glass rim portion and the front glass was assembled in an automotive frame.

When the light transmittance of the transparent antenna 1 was measured, it was 75% and the existence of the antenna pattern could be scarcely recognized when being seen from the driver's sheet side and an assistant driver's sheet side and does not interfere the driver's visibility.

When an antenna cord was connected to the above-mentioned transparent antenna 1 and the antenna cord was connected to a TV tuner of a car navigation system to receive television broadcasting, a good reception state could be obtained.

(b) Second Embodiment of the Invention

A transparent antenna of the second embodiment is enabled to have letters and designs on an antenna pattern.

Figure 7:
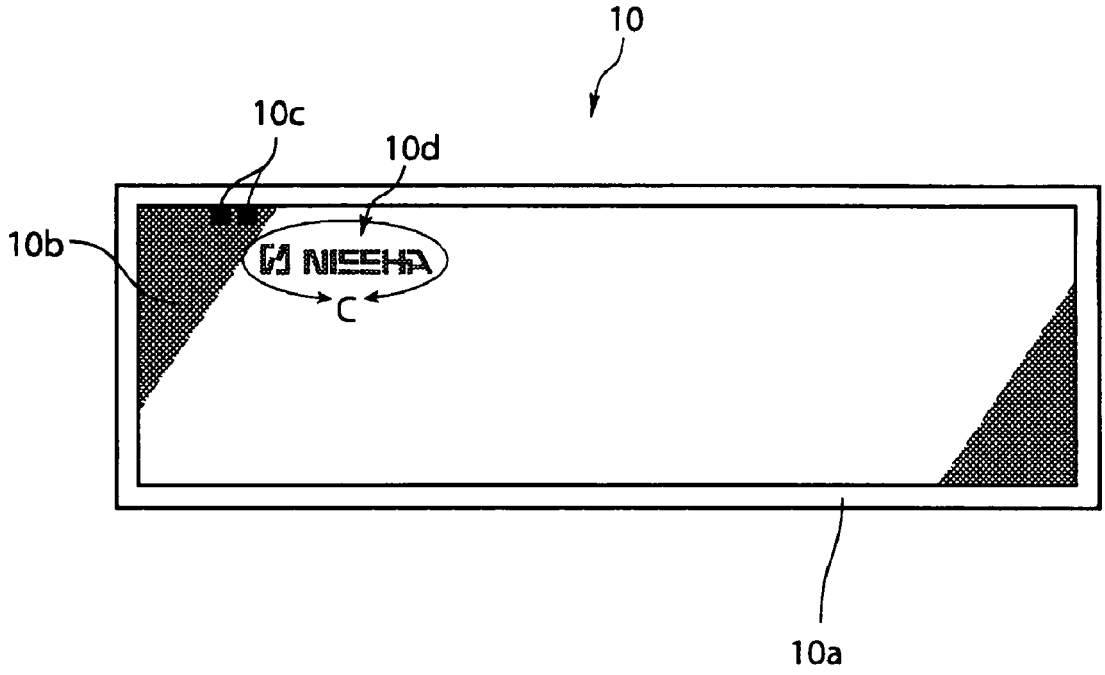
FIG. 7 is an enlarged view of a transparent antenna of a second embodiment of the present invention.

A transparent antenna 10 shown in FIG. 7 comprises an antenna pattern as a electrically conductive section 10*b* planarly formed on a transparent plastic sheet 10*a* as an electrically insulating transparent substrate and an antenna terminal 10*c* is formed in the left upper part of the antenna pattern formed in a transversely elongated rectangular shape.

Reference symbol 10*d* shows a logo designed on the transparent antenna 10, and the formation method of the logo will be described later.

The above-mentioned transparent plastic sheet 10*a* is made of the same material as that of the transparent plastic sheet 1*a* shown in FIG. 2 and the above-mentioned electrically conductive section 10*b* is also made of the same material as that of the electrically conductive section 1*b* and has the same configuration.

The above-mentioned antenna terminal 10*c* is for sticking the electric power supply part (not shown) of the antenna cord 4, and the antenna terminal 10*c* is constructed from a square sheet electrically connected with the mesh-like pattern.

Figure 8:
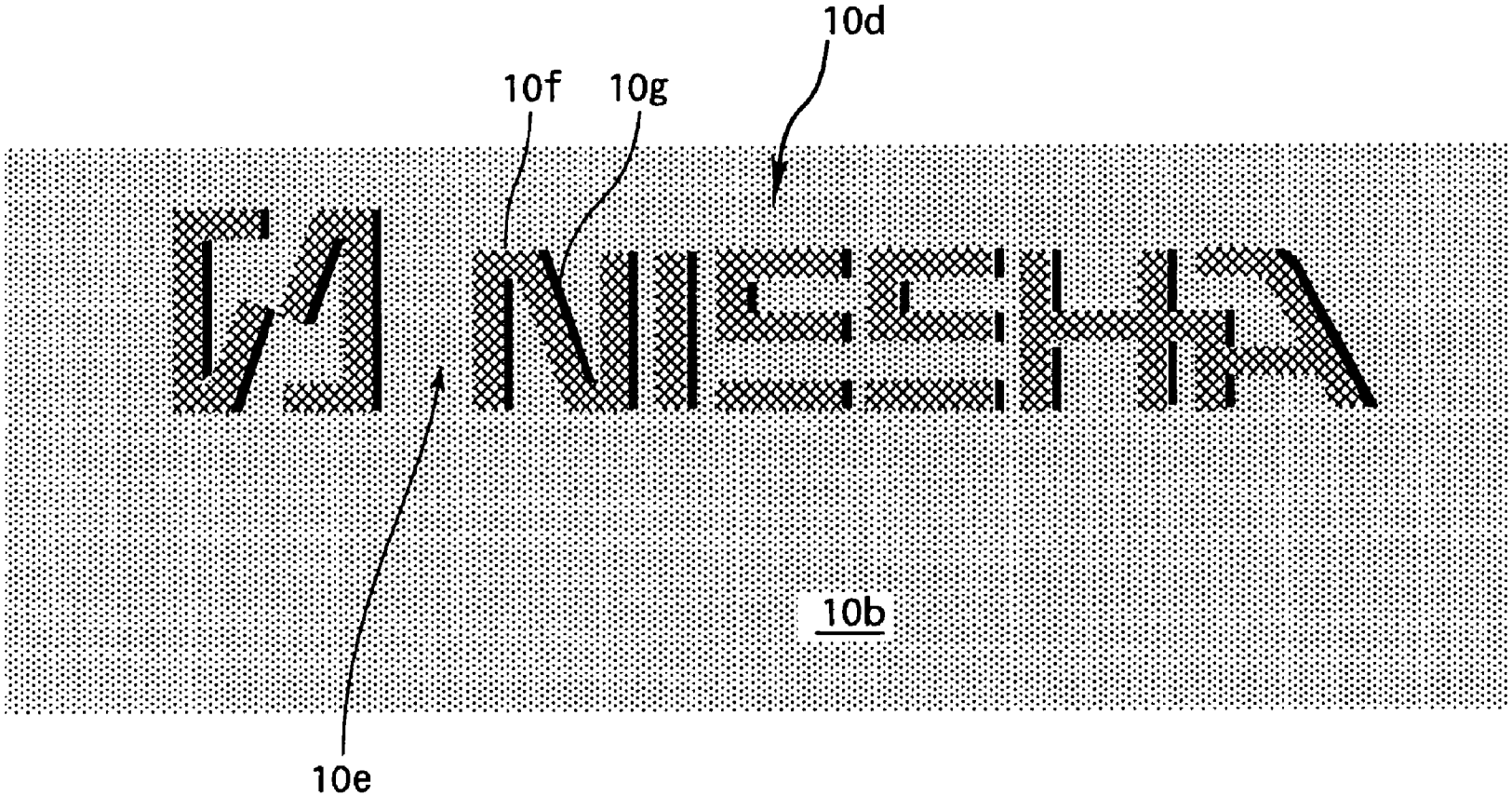
FIG. 8 is an enlarged view of a C part in FIG. 7.

FIG. 8 is an enlarged view of a C part in FIG. 7.

The logo 10*d* was formed on the mesh section 10*e* constructed from the electrically conductive section 10*b* and constructed by combining a letter part 10*f* and a letter shadow section 10*g* showing the shadow of the letter part 10*f*.

Figure 9:
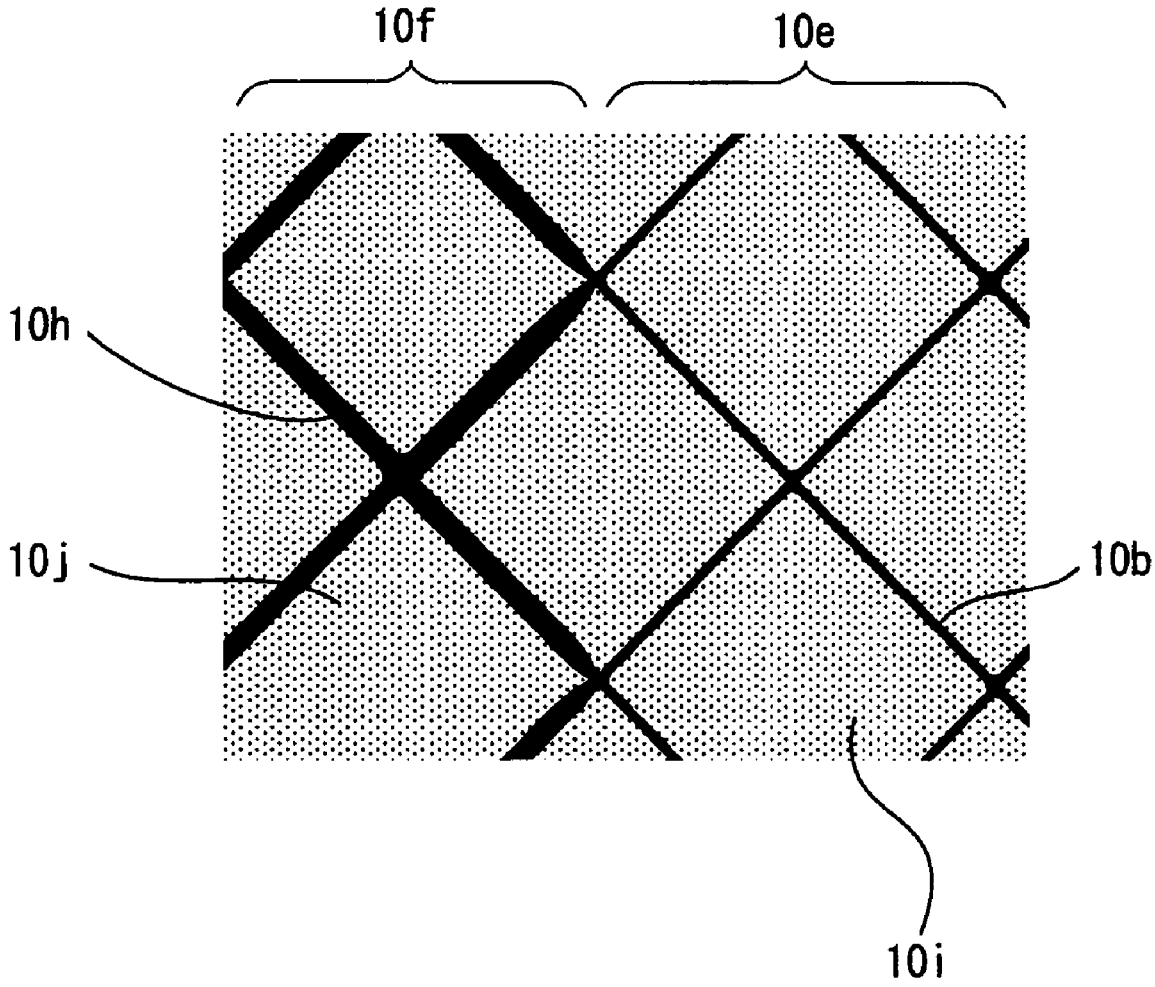
FIG. 9 is an enlarged view of a part of a letter section in FIG. 8.

As shown as an enlarged view in FIG. 9, the letter part 10*f* is constructed from an electrically conductive part (thick band) 10*h* of an electrically conductive wire with a wider width than that of the electrically conductive wire of the mesh section 10*e*, and the aperture surface area of an aperture part 10*j* in the letter part 10*f* is adjusted to be smaller than the aperture surface area of the aperture part 10*i* of the mesh section 10*e*, so that the light transmittance is changed and accordingly, the boundary of the mesh section 10*e* and the letter part 10*f* is emphasized to make the letter part 10*f* outstanding.

Figure 10:
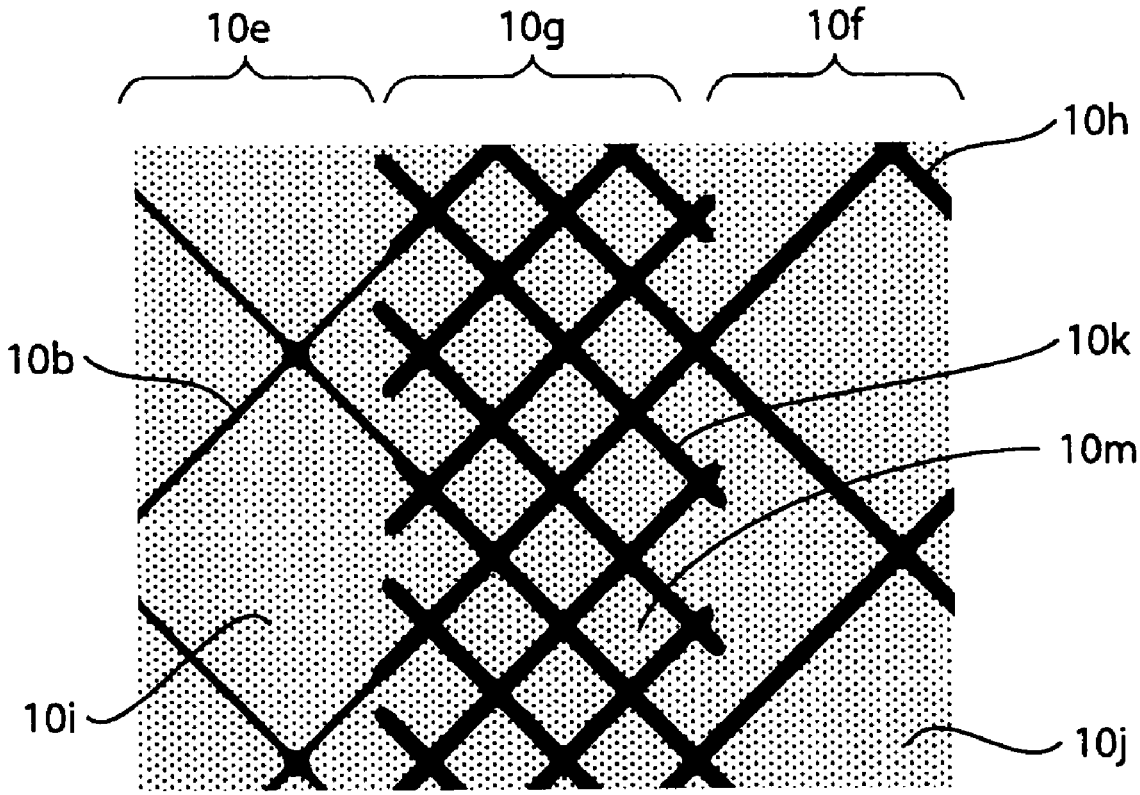
FIG. 10 is an enlarged view of a letter shadow section in FIG. 8.

On the other hand, the letter shadow part 10*g* shown in FIG. 8 has the same width as that of the electrically conductive wire of the letter part 10*f* as being seen in further enlarged view of FIG. 10; however, it is configured using the electrically conductive part 10*k* in a mesh pattern smaller than the letter part 10*f* and thus the aperture surface area of an aperture part 10*m* in the letter shadow part 10*g* is adjusted to be smaller than the aperture surface area of the aperture part 10*j* in the letter part 10*f*, so that the letter shadow part 10*g* can be emphasized. The aperture surface area of an aperture part 10*m* in the letter shadow part 10*g* is set to be about ¾ to ¼ of the aperture surface area of the letter part 10*f*.

The letter part 10*f* and the letter shadow part 10*g* have a function as a recognition pattern for recognizing a part of the antenna pattern by decreasing a prescribed quantity of the light passing through the meshes.

Accordingly, as shown in FIG. 8, the letter part 10*f* is formed in dark mesh pattern on the pale color mesh section 10*e*, and the letter shadow part 10*g* in a dense mesh pattern is formed in the right side of the letter section 10*f*.

As a result, the designed logo 10*d* can be clearly outstandingly seen on the mesh section 10*e*.

Moreover, the logo 10*d* formed in the above-mentioned manner keeps the mesh pattern having the aperture parts with difference in the thickness and density and therefore, no light transmitting property is lost.

Figure 11:
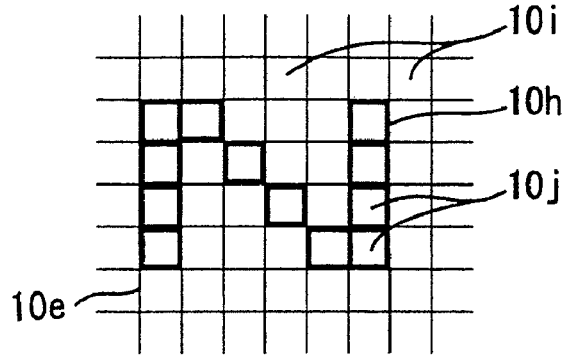
FIG. 11(*a*) to 11(*c*) are explanatory drawings showing a letter-designing method by emphasis.
Figure 11B:
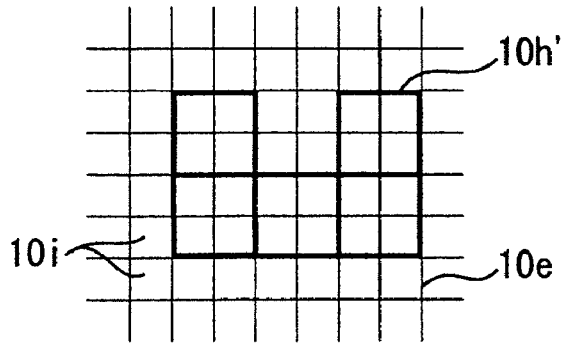
Figure 11C:
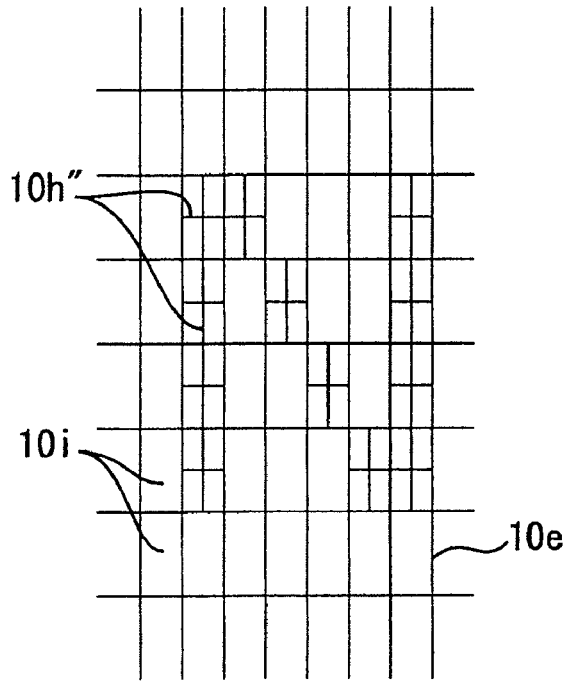

FIGS. 11(*a*) to 13 show various kinds of formation methods of the recognition patterns.

FIG. 11(*a*) shows each mesh of the mesh section 10*e* as a unit and an electrically conductive part 10*h* constructed from an electrically conductive wire with a width thicker than that of the electrically conductive wire of the mesh section 10*e* to emphasize the logo "N".

FIG. 11(*b*) shows a plurality of meshes (four meshes in this drawing) as a unit and an electrically conductive part 10*h*' formed in the meshes using an electrically conductive wire with a width thicker than that of the electrically conductive wire of the mesh section 10*e* to emphasize the U-shaped logo.

FIG. 11(*c*) shows a single mesh divided into a plurality of meshes (four divided sections in this drawing) as a unit and an electrically conductive part 10*h*" in a cross formed in the mesh to emphasize the logo "N".

Figure 12:
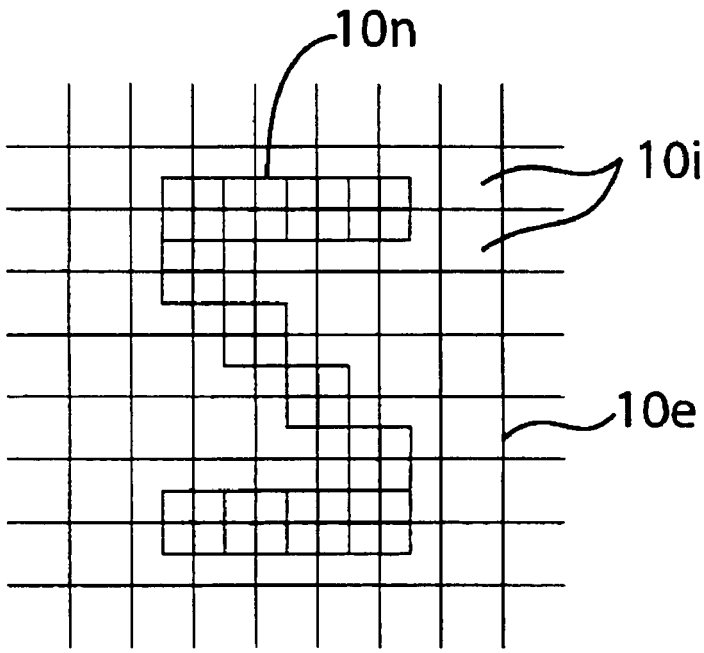
FIG. 12 is an explanatory drawing showing a letter-designing method by shifting the design.

FIG. 12 shows the logo "S" in a state that the letter pattern 10*n* is shifted to a part of the mesh section 10*e* having an aperture part 10*i* with a square shape, and the square shape composing the latter pattern 10*n* is made to have the same size as the square shape composing the mesh section 10*e* and moved in parallel along the diagonal direction of the aperture part 10*i* in the mesh section 10*e*.

Figure 13:
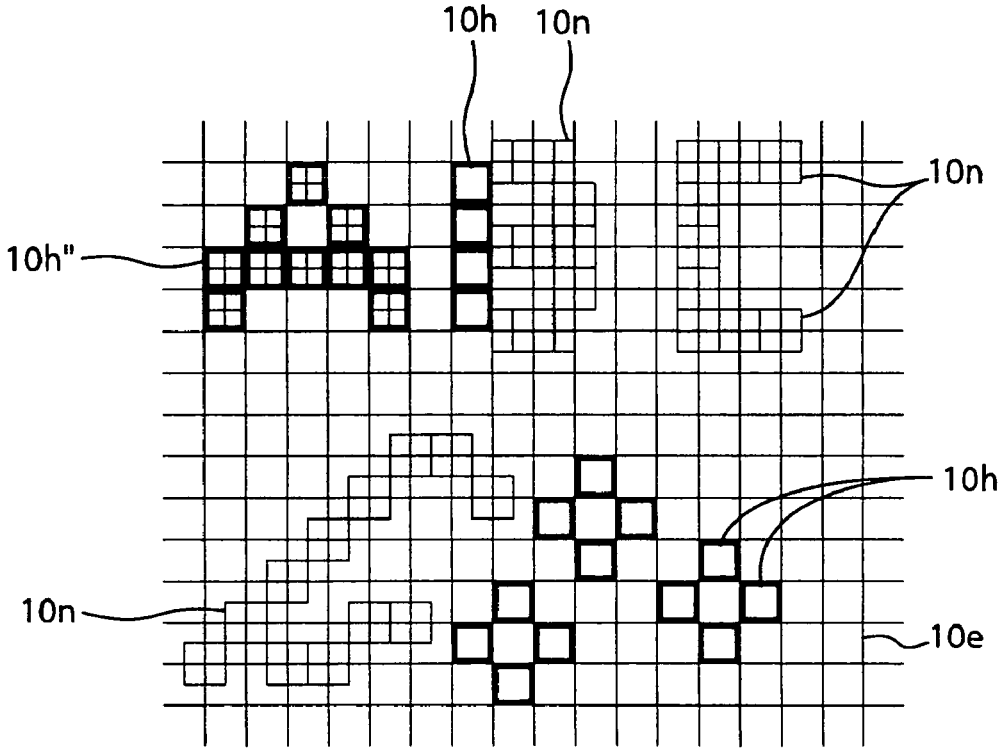
FIG. 13 is an explanatory drawing showing a letter-designing method by both of emphasis and shifting the design.

FIG. 13 shows a combination of the emphasizing method illustrated in FIGS. 11(*a*)-(*c*) and the emphasizing method by shifting illustrated in FIG. 12. If various kinds of emphasizing methods are employed as described, not only letters but also designed patterns can be arbitrarily expressed.

In the above-mentioned embodiment, the letter patterns are formed continuously on the antenna pattern; however if the letter patterns can be recognized as letters, the letter patterns may be formed intermittently by, for example, skipping one mesh.

Next, a production process of a transparent antenna of the present invention on which letters or patterns are designed will be described.

EXAMPLE 3

A 125 μm-thick transparent polyester film and a 18 μm-thick copper foil were laminated through an adhesive, and a transparent pressure sensitive adhesive layer was formed on a face opposite the copper foil of the polyester film.

Next, after liquid-like photoresist was applied to the copper foil face, exposure was carried out using a photomask.

The photomask had an antenna pattern mainly having aperture parts in a square lattice (20 μm in line width of the electrically conductive section, 500 μm in wiring pitches of the electrically conductive section) and a different square lattice (40 μm in line width of the electrically conductive section, 500 μm in wiring pitches of the electrically conductive section) with a different aperture ratio was formed in a part of the antenna pattern along a letter shape.

The antenna pattern having the above-mentioned square lattices with different aperture ratios was produced on the basis of CAD data inputted by a personal computer, using an automatic drawing apparatus.

Next, the resist on parts other than the antenna pattern was removed using developer solution by a conventionally known development treatment and further etching was carried out and resist removal was carried out using a stripping solution to form a letter shape design on the antenna pattern.

In the translucent antenna produced in the above-mentioned manner, it was confirmed that the square lattices (see reference symbol 10*h*) with different aperture ratios as shown in FIG. 11(*a*) appeared and that the latter formed on the antenna pattern was integrated with the antenna pattern and was excellent in a design. Further, with respect to the square lattice (reference symbol 10*h*) parts with different aperture ratios, since the translucency was reliably maintained, the transparency was good.

EXAMPLE 4

After a transparent anchor layer, in which an electroless plating catalyst was dispersed, was formed on a 100 μm-thick transparent polycarbonate film, electroless plating and electroplating were carried out to obtain a 5 μm-thick electrically conductive layer and form low-reflection layers on both faces.

Thereafter, photoresist was applied and exposure was carried out using a photomask.

The photomask had an antenna pattern mainly having aperture parts in a square lattice (30 μm in line width of the electrically conductive section, 800 μm in wiring pitches of the electrically conductive section) and a square lattice (30 μm in line width of the electrically conductive section, 800 μm in wiring pitches of the electrically conductive section) was moved in parallel to a part of the antenna pattern to form a pattern along a letter shape.

Next, a conventionally known development treatment, etching, and resist removal were carried out to design the letter shape in the antenna pattern.

In the translucent antenna produced in the above-mentioned manner, it was confirmed that letters appeared in the state that the square lattices (see reference symbol 10*n*) with different aperture ratios as shown in FIG. 12, and as a result, the translucent antenna with good transparency and excellent design was obtained.

EXAMPLE 5

After a transparent anchor layer, in which an electroless plating catalyst was dispersed, was formed on a 125 μm-thick transparent polyester film, electroless plating and electroplating were carried out to obtain a 4 μm-thick electrically conductive layer.

Thereafter, photoresist was applied and exposure was carried out using a photomask.

The photomask had a pattern mainly having aperture parts in a rectangular lattice (20 μm in line width of the electrically conductive section, wiring pitches of electrically conductive section: 500 μm in transverse direction×900 μm in vertical direction) and a pattern along a letter shape was formed in a part of the antenna pattern with a square lattice (20 μm in line width of the electrically conductive section, wiring pitches of electrically conductive section: 250 μm in transverse direction×450 μm in vertical direction) having a changed aperture ratio by dividing a single rectangular lattice into 4 parts.

Next, a conventionally known development treatment, etching, and resist removal were carried out to design the letter shape in the antenna pattern. As a result, a translucent antenna with good transparency and excellent design was obtained.

EXAMPLE 6

A design with a letter shape was formed on an antenna pattern in the same manner as Example 3 by carrying out conventionally known etching treatment and resist removal, except that printing resist was used and patterning was carried out using an antenna pattern mainly having aperture parts in a square lattice (30 μm in line width of the electrically conductive section, 500 μm in wiring pitches of the electrically conductive section) and a screen plate having letter shape in a square lattice (100 μm in line width of the electrically conductive section, 500 μm in wiring pitches of the electrically conductive section) with different aperture ratio on a part of the antenna pattern. As a result, although the pattern formation precision was decreased as compared with that by the photoresist method shown in above-mentioned Examples 3 to 5, a translucent antenna with good transparency and excellent design was easily obtained.

According to the above-mentioned second embodiment, while maintaining the light transmittance and antenna performance, the transparent antenna having excellent design properties can be provided.

(c) Third Embodiment of the Present Invention

A transparent antenna shown as the third embodiment is made to harmonize the transparent antenna and front glass while maintaining the light transmittance and antenna performance.

Figure 14:
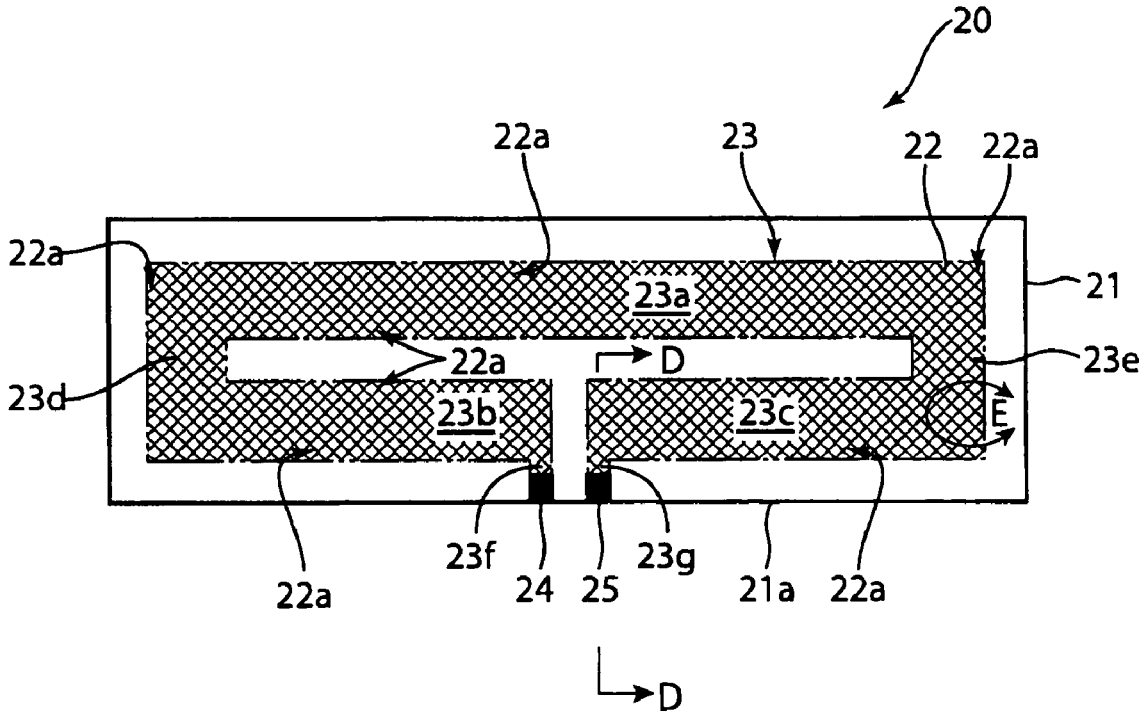
FIG. 14 is an enlarged view of a transparent antenna of a third embodiment of the present invention.

In a transparent antenna 20 shown in FIG. 14, an antenna pattern 23 was formed planarly as an electrically conductive section 22 on a transparent plastic sheet 21.

The antenna pattern 23 is constructed from a band-like pattern 23*a* formed longitudinally in almost the entire length of the transparent plastic sheet 21, band-like patterns 23*b* and 23*c* arranged at a distance and in parallel to the band-like pattern 23*a*, connection parts 23*d* and 23*e* for connecting the band-like patterns 23*a* and 23*b* as well as the band-like patterns 23*a* and 23*c*, respectively, and lead parts 23*f* and 23*g* extended toward a lower rim 21*a* of the transparent plastic sheet 21 from the opposed band-like patterns 23*b* and 23*c*, and antenna terminals 24 and 25 are attached to the tip ends of the respective lead parts 23*f* and 23*g*.

The meshes in the electrically conductive section 22 are composed by regularly continuing geometric designs with the same size and same shape, and the transmittance of light passing through the electrically conductive section 22 can be controlled by changing the setting of the aperture surface area of the meshes.

The above-mentioned antenna terminals 24 and 25 are for sticking an electric power supply part of an antenna cord, which is not shown, and the antenna terminals 24 and 25 are constructed from a square sheet electrically connected with the electrically conductive section 22.

Figure 15:
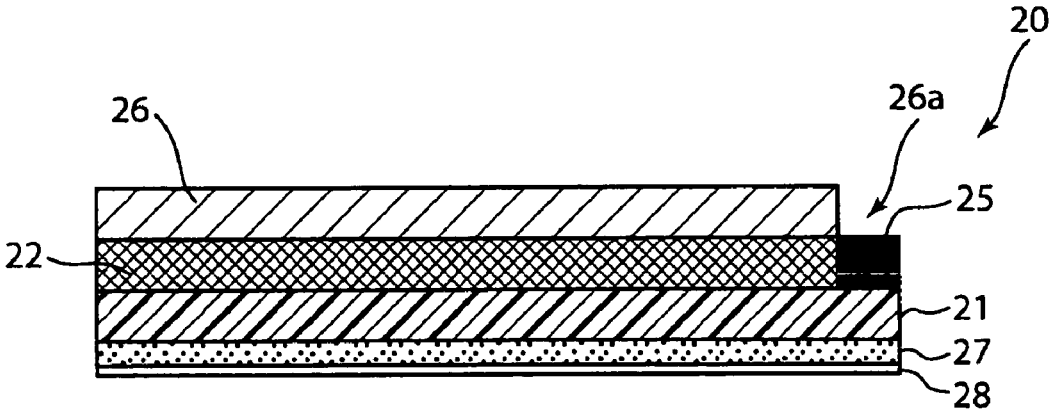
FIG. 15 is a cross-sectional view along the line D-D in FIG. 14.

FIG. 15 is a cross-sectional view along the line D-D in FIG. 14.

In the drawing, the electrically conductive section 22 of a mesh structure is formed on the transparent plastic sheet 21 and the electrically conductive section 22 is covered with a transparent protection film 26.

A through hole part 26*a* is formed in a part of the transparent protection film 26, and the antenna terminal 25 is exposed to the through hole part 26*a*. The electric power supply part of the antenna cord is stuck to the exposed antenna terminal 25.

Reference numeral 27 denotes a transparent pressure sensitive adhesive layer and reference numeral 28 denotes a separating sheet.

Figure 16:
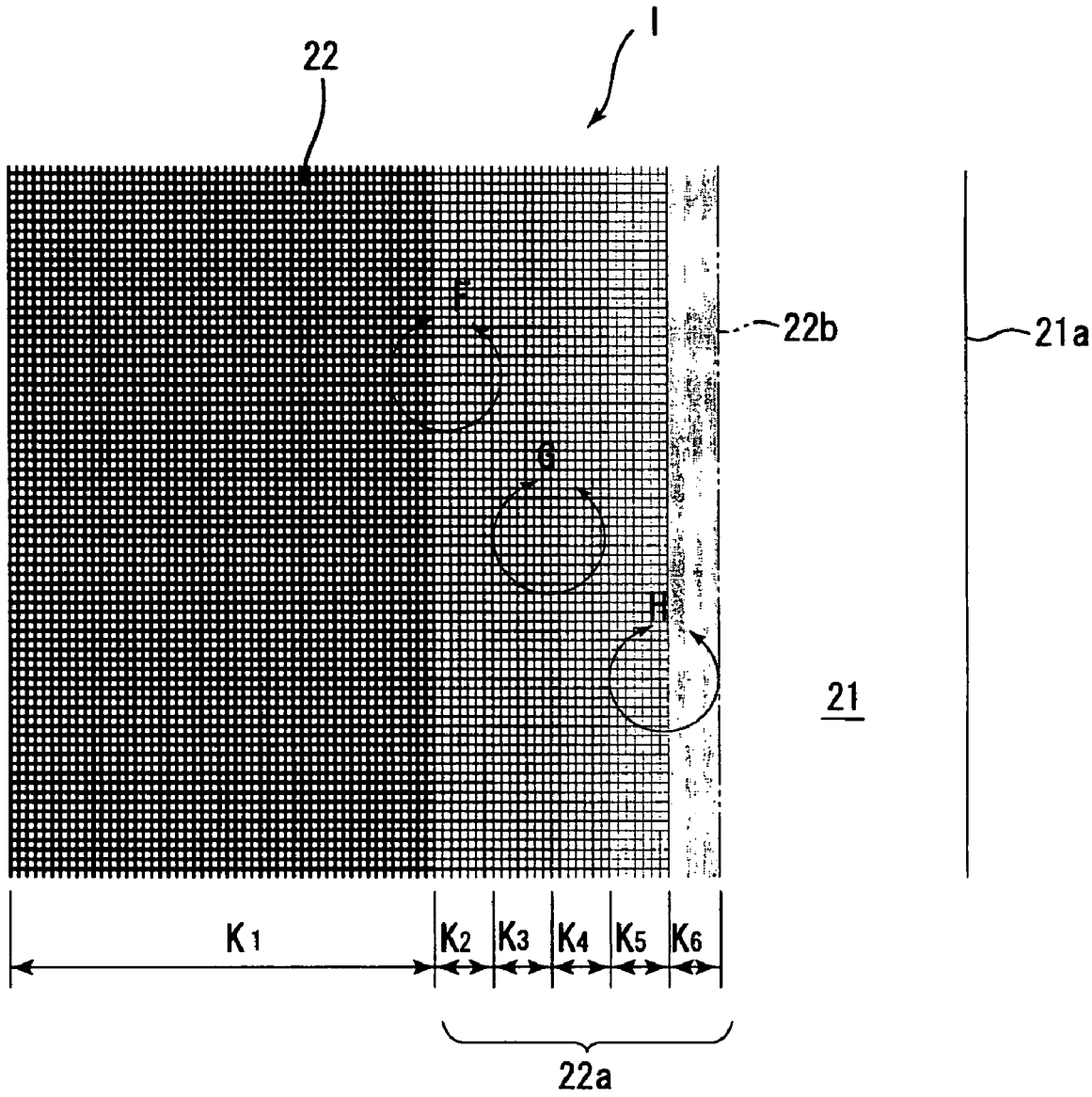
FIG. 16 is an enlarged view of an E part in FIG. 14.

FIG. 16 is an enlarged view of an E part in FIG. 14, that is the boundary region of the antenna pattern 23 and the transparent plastic sheet 21, which is an antenna pattern non-formation section.

With respect to FIG. 16, in a boundary region I, a gradation section 22*a* for decreasing the luminance difference between the antenna pattern 23 and an antenna pattern non-formation section is formed.

In the drawing, reference symbol $K_1$ denotes an electrically conductive section region forming the antenna pattern. Reference symbol $K_2$ denotes a first region with slightly brighter tone (higher light transmittance) than the electrically conductive section region $K_1$ in the gradation section 22*a* formed in the outer rim portion of the electrically conductive section region $K_1$; reference symbol $K_3$ denotes a second region with a brighter tone than the first electrically conductive section region $K_2$; reference symbol $K_4$ denotes a third region with a brighter tone than the second electrically conductive section region $K_3$; reference symbol $K_5$ denotes a fourth region with a brighter tone than the third electrically conductive section region $K_4$; and reference symbol $K_6$ denotes a fifth region with a brighter tone than the fourth electrically conductive section region $K_5$.

The light transmittance of the fifth electrically conductive section region $K_6$ is approximately close to the light transmittance of the transparent plastic sheet 21.

In the drawing, reference numeral 22*b* denotes the outermost periphery edge of the gradation section 22*a* and reference numeral 21*a* shows the right rim of the transparent plastic sheet 21.

The light transmittance, which is a gauge of the transparency, means the total luminous transmittance for the quantity of the total luminance of light with entire wavelength emitted from a light source having a specified color temperature and transmitted through a sample face. If the light transmittance is lower than 70%, when the transparent antenna 20 is attached, for example, to the front glass of an automobile, the difference between the light transmittance of the front glass and the light transmittance of the transparent antenna 20 becomes wide to make the antenna pattern of the transparent antenna 20 appear dark. Therefore, the existence of the antenna becomes an obstacle. If it interferes in the driver's visibility of the front glass, safety is diminished.

The above-mentioned light transmittance is measured using a spectroscopic analyzer (model number NDH 2000) manufactured by Nippon Denshoku Industries Co., Ltd. Also, the light transmittance of 100% in an air layer is defined as the standard.

In the case where the transparent protection film 26 is formed in the transparent antenna 20, the measurement of the light transmittance is carried out in the state that the transparent protection film 26 is included and in the case where the transparent pressure sensitive adhesive layer 27 is formed, the measurement is carried out in the state that the transparent pressure sensitive adhesive layer 27 is included.

Figure 17:
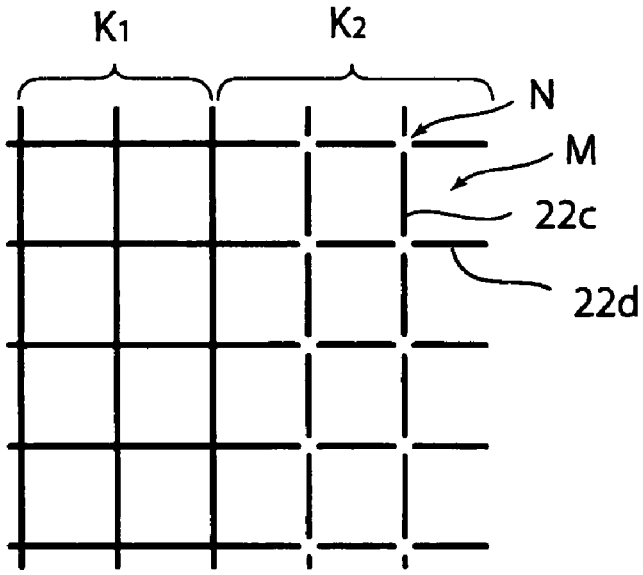
FIG. 17 is an enlarged view of an F part in FIG. 16.
Figure 18:
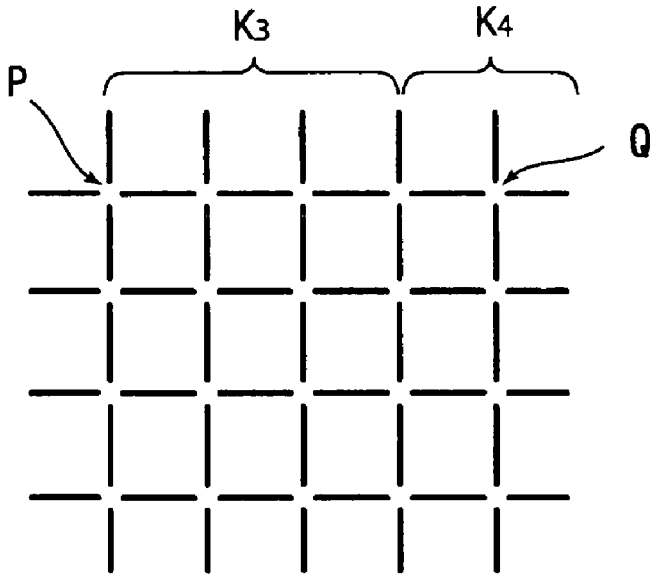
FIG. 18 is an enlarged view of a G part in FIG. 16.
Figure 19:
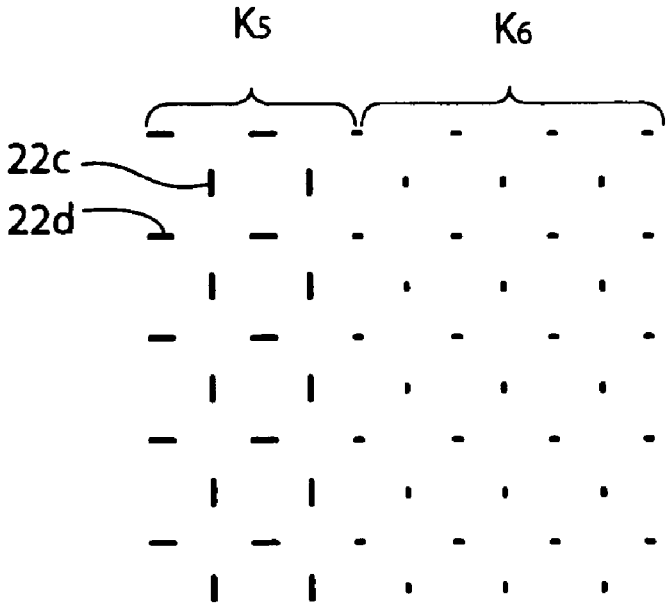
FIG. 19 is an enlarged view of an H part in FIG. 16.

FIG. 17 is an enlarged view of an F part in FIG. 16; FIG. 18 is an enlarged view of a G part in FIG. 16; and FIG. 19 is an enlarged view of an H part in FIG. 16.

At first, in FIG. 17, the first region $K_2$ formed in the outside of the electrically conductive section region $K_1$ loses all of the crossing points of the vertical direction electrically conductive wire 22*c* forming the lines of the mesh and the transverse direction electrically conductive wire 22*d* and in such a manner, formation of the crossing point-lost section N increases the light transmittance to greater than that in the conductive part region $K_1$.

The wire width w of the vertical direction electrically conductive wire 22*c* and the transverse direction electrically conductive wire 22*d* is made to be 30 μm width or thinner. If the wire width w exceeds 30 μm, the meshes of the antenna pattern become outstanding and the design is also worsened. If the wire width w is 30 μm or thinner, the existence of the antenna pattern is hardly recognized. Additionally, if the film thickness of the electrically conductive wire is controlled to give the aspect ratio of the wire width/film thickness t of 0.5 or higher, production of an antenna pattern with a good precision is made easy.

In this embodiment, the light transmittance of the transparent antenna 20 is adjusted to keep a 70% or higher light transmittance by selecting a combination of the wire width of the vertical direction electrically conductive wire 22*c* and the transverse direction electrically conductive wire 22*d* and aperture size of the meshes formed by surrounding with these electrically conductive wires 22*c* and 22*d*.

In FIG. 18, the second region $K_3$ formed in the outside of the first region $K_2$ has a wider lost range of the crossing point of the vertical direction electrically conductive wire 22*c* and the transverse direction electrically conductive wire 22*d* than the above-mentioned crossing point-lost section N and formation of such a crossing point-lost section P increases the light transmittance to greater than that in the electrically conductive section region $K_1$.

On the other hand, the third region $K_4$ formed in the outside of the second region $K_3$ has a wider crossing point-lost section Q than the crossing point-lost section P.

In the fourth region $K_5$ shown in FIG. 19, a part of the vertical direction electrically conductive wire 22*c* and a part of the transverse direction electrically conductive wire 22*d* exist while keeping the directionality, and the mesh shape is lost.

In the fifth region $K_6$, a part of the vertical direction electrically conductive wire 22*c* and a part of the transverse direction electrically conductive wire 22*d* exist in an island-like dotted state while scarcely keeping the directionality.

In such a manner, due to the gradation section 22*a* having the luminous tone gradually increased step by step (5 grades in this embodiment) from the electrically conductive section 22, the boundary part of the antenna pattern 23 and the transparent plastic sheet 21 is hardly noticeable and the existence of the antenna pattern 23 itself can be made also unnoticeable.

FIG. 20 to FIG. 23 show modification examples of the gradation section 22*a*.

Figure 20:
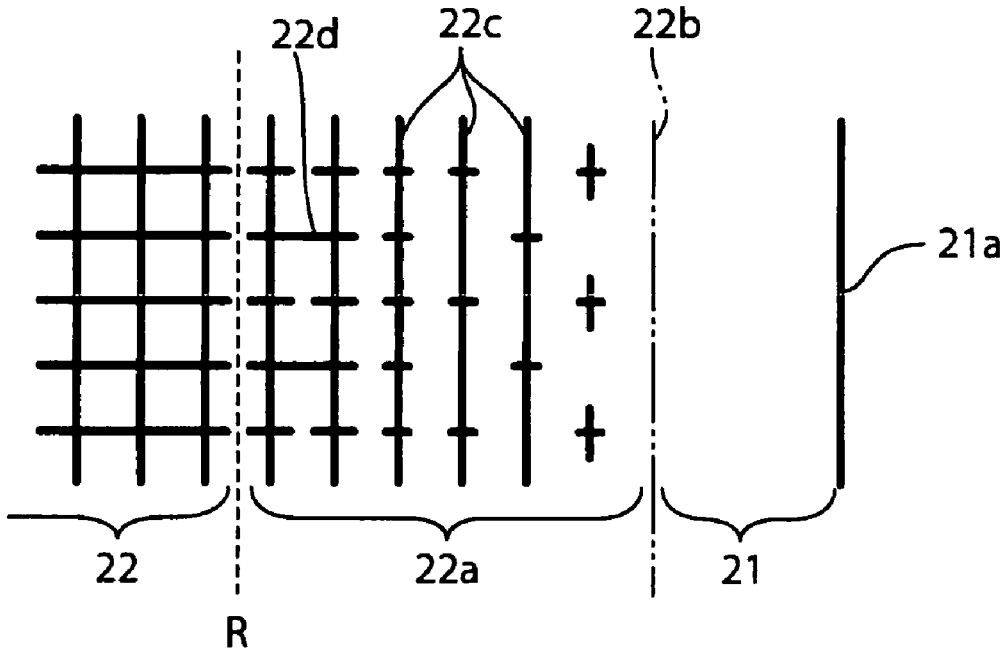
FIG. 20 is an explanatory drawing showing a first modification example of gradation of the third embodiment.

At first, with respect to the gradation section 22*a* shown in FIG. 20, the gradation provided with light transmittance is formed by leaving the vertical direction electrically conductive wire 22*c* and eliminating a plurality of points in the right side end portion of the transverse direction electrically conductive wire 3*d*. In the drawing, reference symbol R denotes a boundary of the electrically conductive section 22 and the gradation section 22*a*; reference symbol 22*b* denotes the outermost periphery rim of the gradation section 22*a*; and 21 denotes a transparent plastic sheet, respectively.

Figure 21:
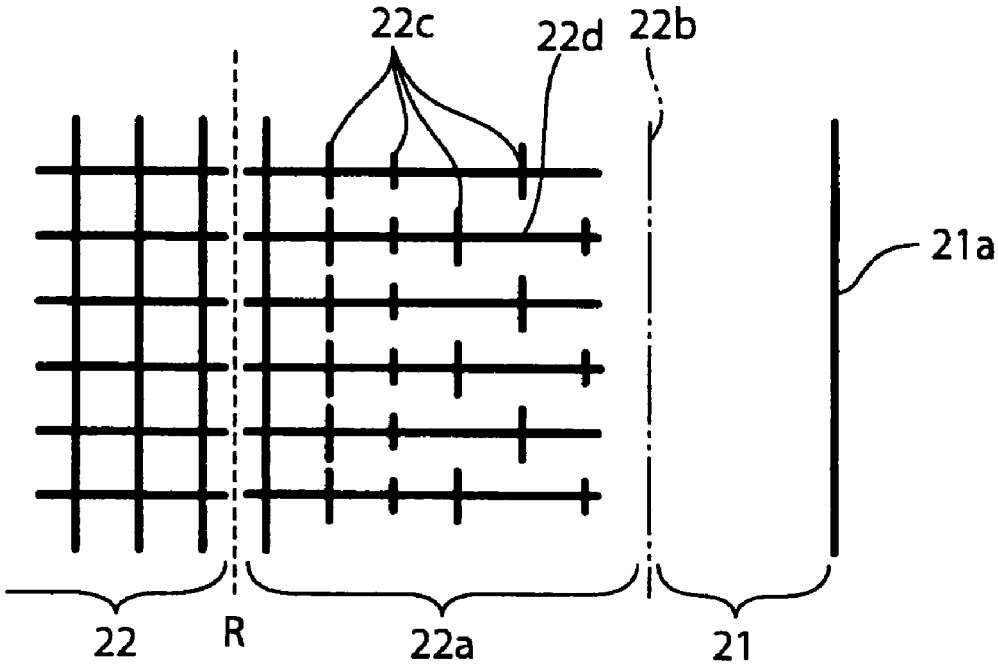
FIG. 21 is an explanatory drawing showing a second modification example of gradation.

With respect to the gradation section 22*a* shown in FIG. 21, contrary to FIG. 20, the gradation provided with light transmittance is formed by leaving the transverse direction electrically conductive wire 22*d* and eliminating a plurality of points of the vertical direction electrically conductive wire 22*c*.

Figure 22:
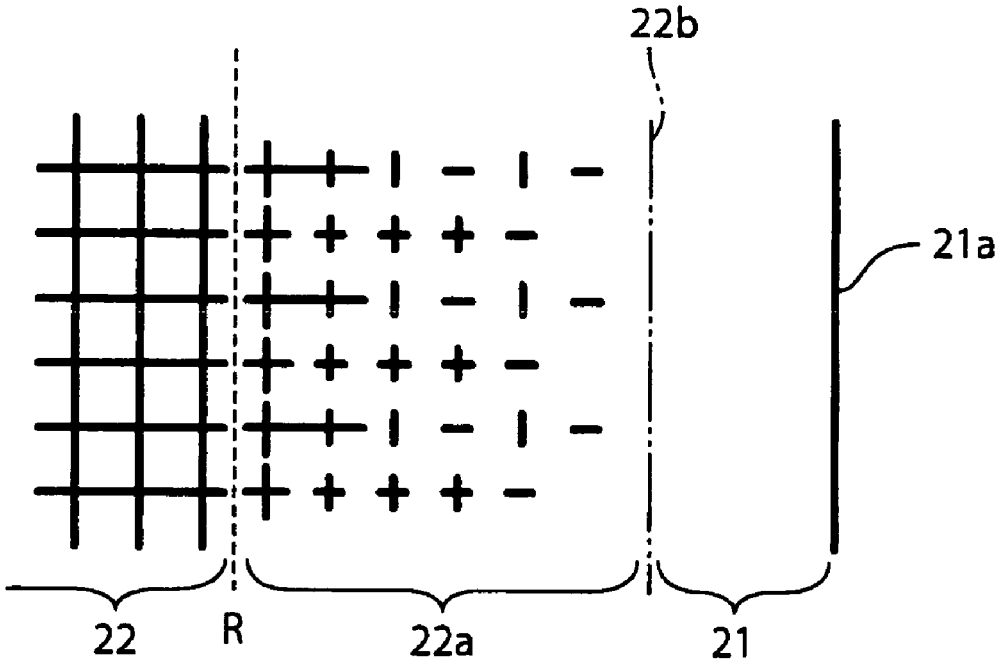
FIG. 22 is an explanatory drawing showing a third modification example of gradation.

With respect to the gradation section 22*a* shown in FIG. 22, the techniques of FIG. 20 and FIG. 21 are combined and gradation provided with light transmittance is formed by eliminating a plurality of points in part of the transverse direction electrically conductive wire 22*d* and the vertical direction electrically conductive wire 22*c* respectively.

Although the light transmittances of FIG. 20 and FIG. 21 are approximately same, the light transmittance of FIG. 22 becomes high as compared with that of FIG. 20 and FIG. 21.

Figure 23:
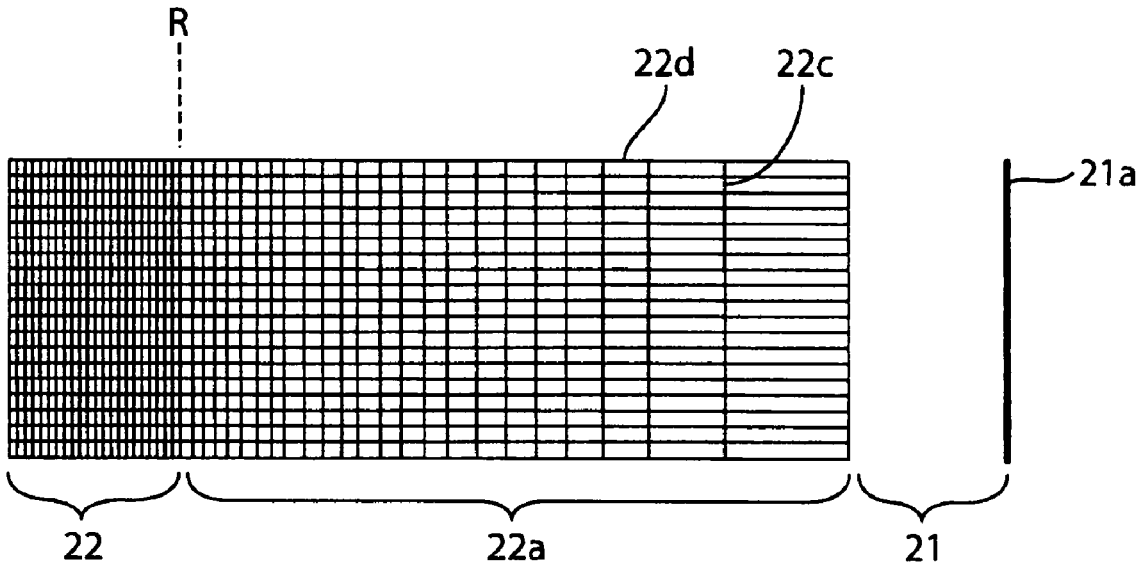
FIG. 23 is an explanatory drawing showing a fourth modification example of gradation.

In the embodiments shown in FIG. 20 to FIG. 22, gradation is formed by eliminating the electrically conductive wires, and on the other hand, as shown in FIG. 23, the gradation section 22*a* may be formed by coarsening the meshes, in particular, widening the intervals of vertical direction electrically conductive wire 22*c* forming the meshes step by step toward the transparent plastic sheet.

According to the gradation section 22*a*, although the gradation effect is low as compared with that by the above-mentioned elimination of the electrically conductive wires, the gradation section 22*a* has an advantage in that the part is also made usable as an antenna.

Next, the production process of a transparent antenna 20 having the gradation section 22*a* of the present invention will be described.

EXAMPLE 7

A 100 μm-thick transparent polyester film and a 18 μm-thick copper foil were laminated using an adhesive and a transparent pressure sensitive adhesive layer was formed on a face opposite the copper foil of the polyester film.

Next, after liquid-phase photoresist was applied to the copper foil face, exposure was carried out using a photomask.

The photomask had an antenna pattern mainly having aperture parts in a square lattice (20 μm in line width of the electrically conductive section, and 500 μm in wiring pitches of the electrically conductive wire) and a gradation section shown in FIG. 20 was formed in the rim portion of the antenna pattern The antenna pattern having the square lattice and the gradation section was produced on the basis of CAD data inputted on a personal computer, using an automatic drawing apparatus.

Next, the resist on parts other than the antenna pattern was removed by a conventionally known development treatment using a developer solution and further etching was carried out and resist removal was carried out using a stripping solution to form the antenna pattern having the gradation section.

The translucent antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

EXAMPLE 8

After a transparent anchor layer, in which an electroless plating catalyst was dispersed, was formed on a 50 μm-thick transparent polycarbonate film, electroless plating and electroplating were carried out to obtain a 5 μm-thick electrically conductive layer and form low-reflection layers on both faces.

Thereafter, photoresist was applied and exposure was carried out using a photomask.

The photomask had an antenna pattern mainly having aperture parts in a square lattice and the gradation section as shown in FIG. 21 was formed in the rim portion of the antenna pattern.

Next, etching and resist removal were carried out to form an antenna pattern having the gradation section (20 μm in wire width of the electrically conductive wire, and 80 μm in wiring pitches of the electrically conductive wire).

The translucent antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

EXAMPLE 9

After a transparent anchor layer in which an electroless plating catalyst was dispersed was formed on a 125 μm-thick transparent polyester film, electroless plating and electroplating was carried out to obtain a 4 μm-thick electrically conductive layer.

Thereafter, photoresist was applied and exposure was carried out using a photomask.

The photomask had an antenna pattern mainly having aperture parts in a rectangular lattice (10 μLm in wire width of the electrically conductive wire, and wiring pitches: 600 μm in transverse direction×900 μm in vertical direction) and the gradation section as shown in FIG. 23 was formed in the rim portion of the antenna pattern.

Next, etching and resist removal were carried out to form an antenna pattern having the gradation section.

The translucent antenna produced in the above-mentioned manner showed extremely natural gradation in the rim portion of the antenna pattern and it was confirmed that the boundary of the antenna pattern and the transparent plastic sheet was not recognized and the existence of the antenna pattern itself was hardly recognized.

EXAMPLE 10

An antenna pattern having a gradation section was formed in the same manner as Example 7 by carrying out conventionally known etching treatment and resist removal, except that printing resist was used and patterning was carried out using a screen plate in which an antenna pattern mainly having aperture parts in a square lattice (25 μm in line width of the electrically conductive wire, and 1,000 μm in wiring pitches of the electrically conductive wire) was formed.

As a result, although the pattern formation precision was decreased as compared with that by the photoresist method shown in the above-mentioned Examples 7 to 9, a translucent antenna with gradation effect in the rim portion was easily obtained.

According to the above-mentioned second embodiment, while maintaining the light transmittance and antenna performance, the transparent antenna having excellent in design characteristics can be provided.

(d) Fourth Embodiment of the Invention

The transparent antenna 30 shown in the fourth embodiment needs an antenna length for a compact size.

Figure 24:
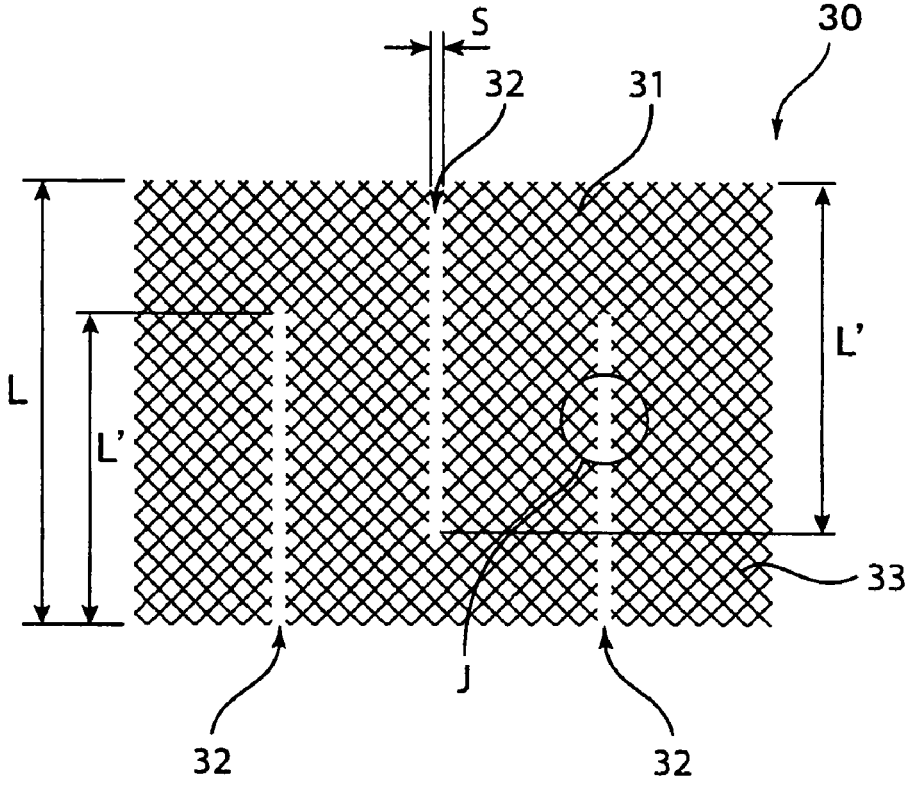
FIG. 24 is a plan view of a transparent antenna of a fourth embodiment of the present invention.

In FIG. 24, while using the antenna pattern 31 formed by continuously arranging the square meshes as an example, it will be explained. A plurality of slits 32 are formed in parallel in a part of antenna pattern 31. The respective slits 23 have lengths L' shorter than the vertical direction length L of the antenna pattern 30 and formed in alternately different directions. Accordingly, the antenna pattern 31 is formed in a zigzag pattern in FIG. 24. In the drawing, reference numeral 33 denotes an electrically conductive section.

Figure 25:
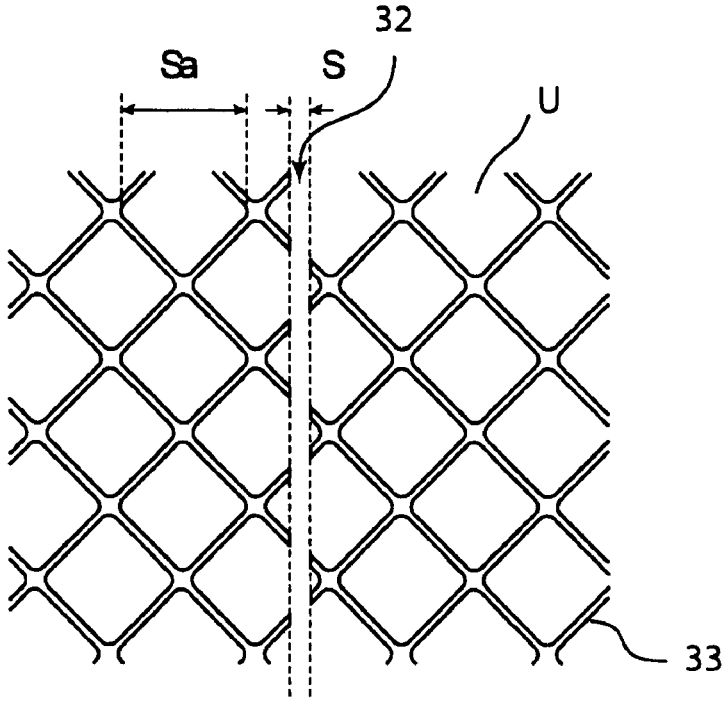
FIG. 25 is an enlarged view of a J part in FIG. 24.

FIG. 25 is an enlarged view of a J part in FIG. 24, S shows the slit width and Sa shows the mesh size. In this case, the mesh size means the diagonal line length in the mesh U.

It is preferable to set the above-mentioned slit width S in a range from 20 μm to the maximum size of the mesh and if the slit width S is less than 20 μm, production becomes difficult and if the slit width S exceeds the maximum size of the mesh, the slits are seen outstandingly and the design is worsened.

If the antenna pattern 31, snaked by forming the above-mentioned slits 32, is expanded to be straight, it is made possible to obtain the length with about ¼ of the wavelength of electric waves, for example UHF waves, to be received.

However, it is required for the arrangement of the slits to keep the slits from the crossing points of meshes U.

It is because if the slits 32 pass the crossing points 34 of the electrically conductive section 33 of the antenna pattern 31, the crossing points are continuously missed to make the existence of the slits outstandingly seen.

Figure 26:
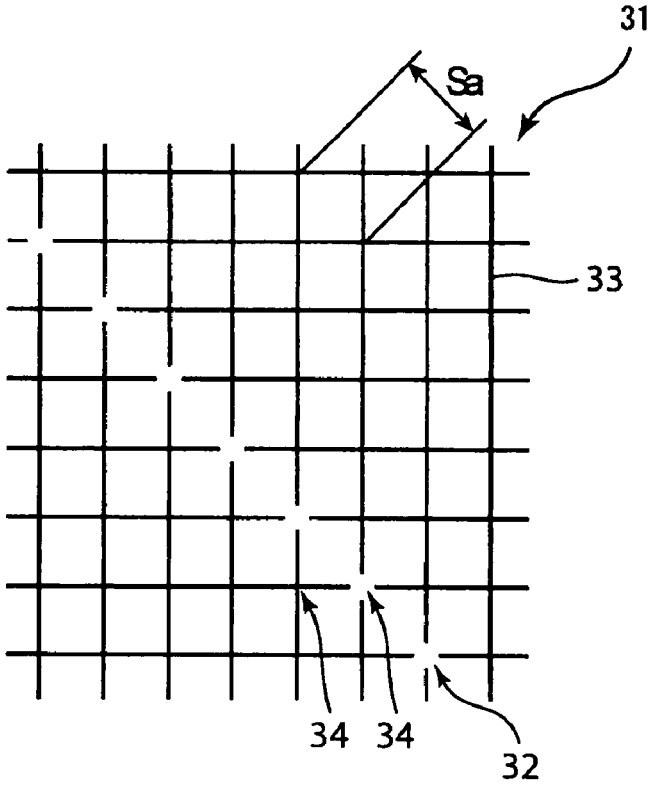
FIG. 26 is an explanatory drawing illustrating arrangement of slits.
Figure 27:
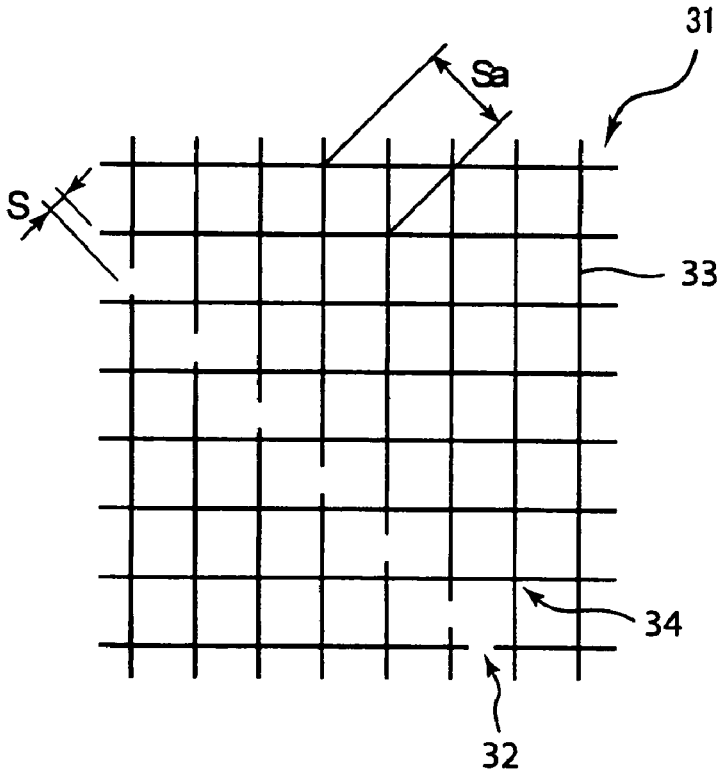
FIG. 27 is an explanatory drawing illustrating the arrangement of slits.

On the other hand, FIG. 27 shows slits 32 avoiding the crossing points 34 of the electrically conductive section 34. As it is made clear by comparison with that in FIG. 26, the existence of the slits 32 is not outstandingly visible.

Figure 28:
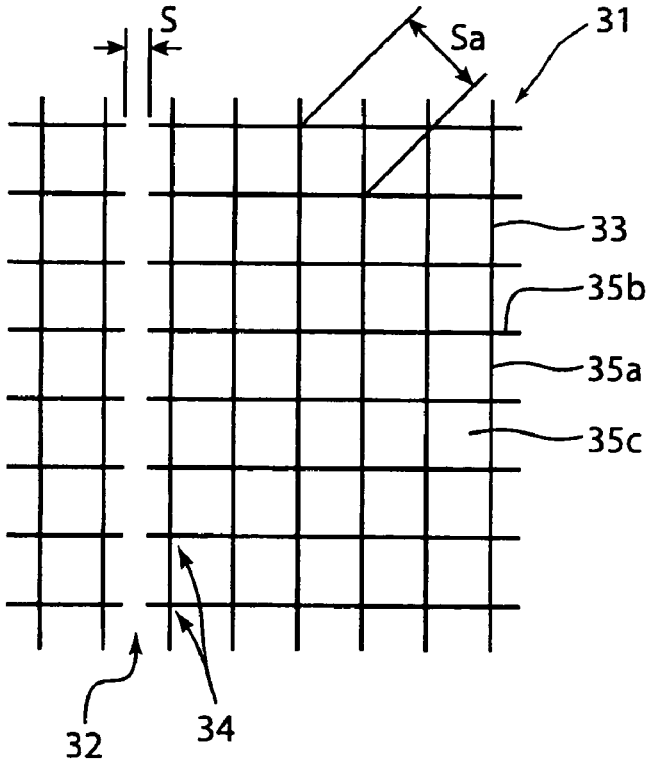
FIG. 28 is an explanatory drawing showing the mesh shape of the antenna pattern and arrangement of slits.

FIG. 28 shows an antenna pattern 31 of square meshes 35*c* formed by arranging the vertical direction electrically conductive wire 35*a* and transverse direction electrically conductive wire 35*b* at equal intervals, and slits 32 are formed along the arrangement direction of the meshes (vertical direction in this drawing) in a part of the antenna pattern 31. The slit width S is set to be about ¼ of the size Sa of the meshes 35*c* and the slits do not pass the crossing point, and thus, the existence of the slits is scarcely seen.

Next, the production process of a transparent antenna 30 of the present invention will be described.

EXAMPLE 11

After a transparent anchor layer, in which a plating catalyst was dispersed, was formed on a 125 μm-thick transparent polycarbonate film, and plating was carried out to form an 8 μm-thick electrically conductive metal layer.

Figure 29:
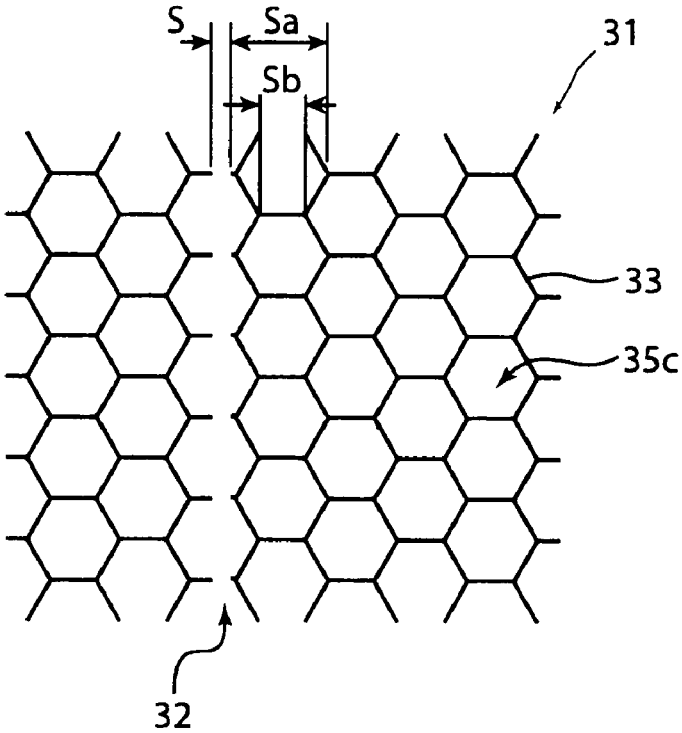
FIG. 29 is an explanatory drawing showing the mesh shape of the antenna pattern and arrangement of slits.

The electrically conductive metal layer was photo-etched to produce a transparent antenna as shown in FIG. 29.

In the transparent antenna, to make an aperture of the mesh 35*c* have a regular hexagonal shape, the wire width of the electrically conductive section 31 was set to be 12 μm, one side length Sb of the mesh 35*c* was set to be 600 μm, and slits 32 with a width S of 100 μm were formed vertically on the antenna pattern 31.

With respect to the transparent antenna formed as described above, both of the antenna pattern 31 and the slits 32 formed on the antenna pattern 31 could not be seen. Accordingly, a transparent antenna was obtained without worsening the design.

EXAMPLE 12

After a transparent anchor layer in which a plating catalyst was dispersed was formed on a 1 mm-thick transparent acrylic plate, plating was carried out to form a 12 μm-thick electrically conductive metal layer and an antenna pattern having slits was formed by photolithography.

Figure 30:
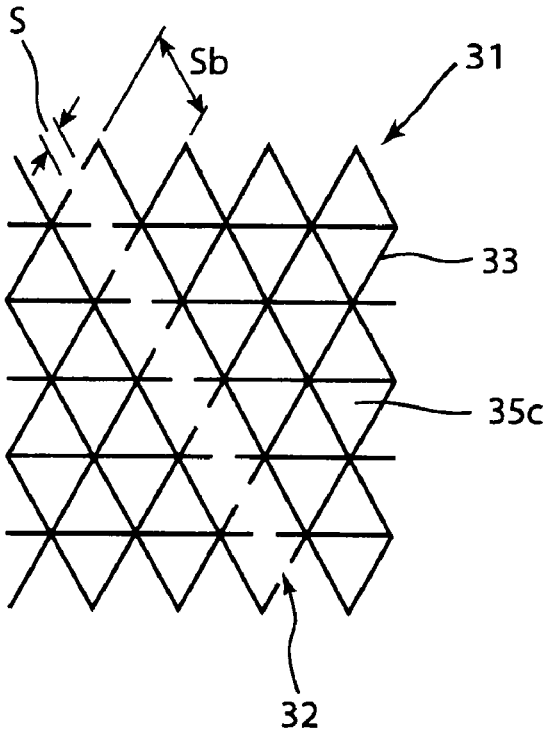
FIG. 30 is an explanatory drawing showing the mesh shape of the antenna pattern and arrangement of slits.

Next, chemical etching was carried out to produce a transparent antenna as shown in FIG. 30.

In the transparent antenna, to make an aperture of the mesh 35*c* have a regular triangle shape, the wire width of the electrically conductive section 33 was set to be 20 μm and one side length Sb of the mesh 35*c* was set to be 900 μm, and slits 32 with a width S of 80 μm were formed slantingly along a mesh arrangement direction.

Further, a transparent resin coating with a thickness of 100 μm was formed as a transparent protection layer on the metal face side of the film in which the antenna pattern 31 was formed.

With respect to this transparent antenna, both of the antenna pattern 31 and the slits 32 formed on the antenna pattern 31 could not be seen. Accordingly, a transparent antenna was obtained without worsening the design.

EXAMPLE 13

Figure 31:
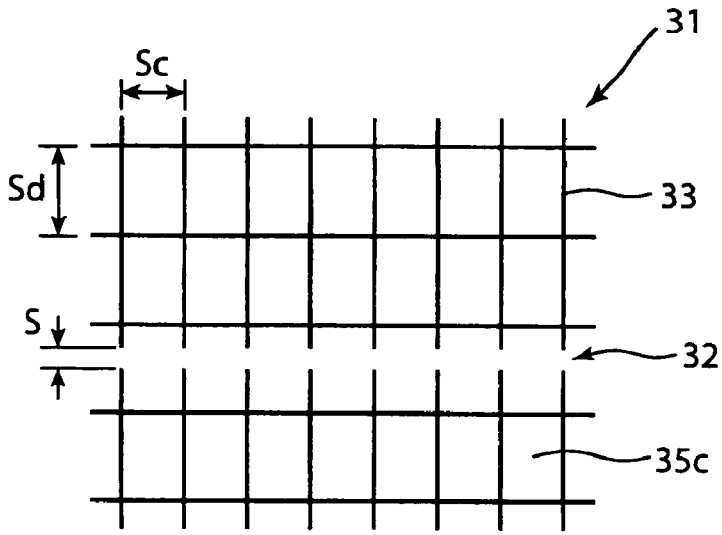
FIG. 31 is an explanatory drawing showing the mesh shape of the antenna pattern and arrangement of slits.

An 18 μm-thick copper foil whose both faces were chemically treated for low-reflection treatment was stuck to a 100 μm-thick transparent polyethylene terephthalate film, and an antenna pattern having slits was formed by photolithography and then chemical etching was carried out to produce a transparent antenna as shown in FIG. 31.

In the transparent antenna, to make an aperture of the mesh 35*c* have a rectangular shape, the wire width of the electrically conductive section 33 was set to be 15 μm, the shorter side length Sc of a single mesh 35*c* was set to be 300 μm, the longer side length Sd was set to be 400 μm, respectively, and slits 32 with a width S of 40 μm were formed transversely on the antenna pattern 31.

Next, a 100 μm-thick transparent polyethylene terephthalate film coated with a pressure sensitive adhesive as a transparent protection layer was stuck to the metal face side of the film on which the antenna pattern 31 was formed.

With respect to this transparent antenna, both of the antenna pattern 31 and the slits 32 formed on the antenna pattern 31 could not be seen and a transparent antenna was obtained without worsening the design.

EXAMPLE 14

An antenna pattern having slits was formed by high precision printing using a silver nano-particle paste on an 800

μm-thick transparent polycarbonate plate to produce a transparent antenna having a 10 μm-thick electrically conductive layer as shown in FIG. 27.

In the transparent antenna, to make an aperture of the mesh 35*c* have a square shape, the wire width of the electrically conductive section 33 was set to be 30 μm one side length Sa of a single mesh 35*c* was set to be 1 mm, and slits 32 with a width S of 150 μm were formed slantingly at an angle of 45° to the mesh 35*c* on the antenna pattern 31.

With respect to this transparent antenna, both of the antenna pattern 31 and the slits 32 formed on the antenna pattern 31 could not be seen, and a transparent antenna was obtained without worsening the design.

EXAMPLE 15

After a transparent anchor layer, in which a plating catalyst was dispersed, was formed on a 50 μm-thick transparent polyethylene terephthalate film, copper plating was carried out to form a 5 μm-thick electrically conductive metal layer.

A resist film was formed on the electrically conductive metal layer, and an antenna pattern having slits was formed by photolithography.

The resulting film was chemically etched using an iron chloride solution and the resist was peeled to produce a transparent antenna as shown in FIG. 29.

In the transparent antenna, the wire width of the electrically conductive section 33 having the mesh in a regular hexagonal shape was set to be 10 μm, one side length Sb of the mesh 35*c* was set to be 900 μm, and slits 32 with a width S of 500 μm were formed vertically on such an antenna pattern 31.

With respect to the transparent antenna formed in the above-mentioned manner, both of the antenna pattern 31 and the slits 32 formed on the antenna pattern 31 could not be seen. Accordingly, a transparent antenna was obtained without worsening the design.

EXAMPLE 16

A 12 μm-thick copper foil whose both faces were chemically treated for low-reflection treatment was stuck to a 2 mm-thick transparent glass plate to form a electrically conductive metal layer.

A resist film was formed on the electrically conductive metal layer, and an antenna pattern having slits was formed by photolithography. Successively, chemical etching was carried out using a cupric chloride solution, and the resist was peeled to produce a transparent antenna as shown in FIG. 30.

In the transparent antenna, the wire width of the electrically conductive section 33 having the mesh in a regular triangle shape was set to be 18 μm, one side length Sb of the mesh 35*c* was set to be 700 μm, and slits 32 with a width S of 300 μm were formed slantingly along the arrangement direction of the mesh 35*c* on such a antenna pattern 31.

With respect to the transparent antenna formed in the above-mentioned manner, both of the antenna pattern 31 and the slits 32 formed on the antenna pattern 31 could not be seen. Accordingly, a transparent antenna was obtained without worsening the design.

EXAMPLE 17

A 12 μm-thick copper foil whose both faces were chemically treated for low-reflection treatment was stuck to a 200 μm-thick transparent acrylic film to form an electrically conductive metal film.

A resist film was formed on the electrically conductive metal layer and an antenna pattern having slits was formed by photolithography. Successively, chemical etching was carried out using a cupric chloride solution, and the resist was peeled to produce a transparent antenna as shown in FIG. 28.

In the transparent antenna, the wire width of the electrically conductive section 33 having the mesh in a square shape was set to be 15 μm, one side length Sa of the mesh 35*c* was set to be 1 mm, and slits 32 with a width S of 1 mm were formed vertically to the mesh 35*c* on such an antenna pattern 31.

With respect to the transparent antenna formed in the above-mentioned manner, both of the antenna pattern 31 and the slits 32 formed on the antenna pattern 31 could not be seen. Accordingly, a transparent antenna was obtained without worsening the design.

Next, with reference to FIG. 32 to FIG. 36, slit formation patterns in a transparent antenna will be described. The respective drawings show the state observed in a plan view.

Figure 32:
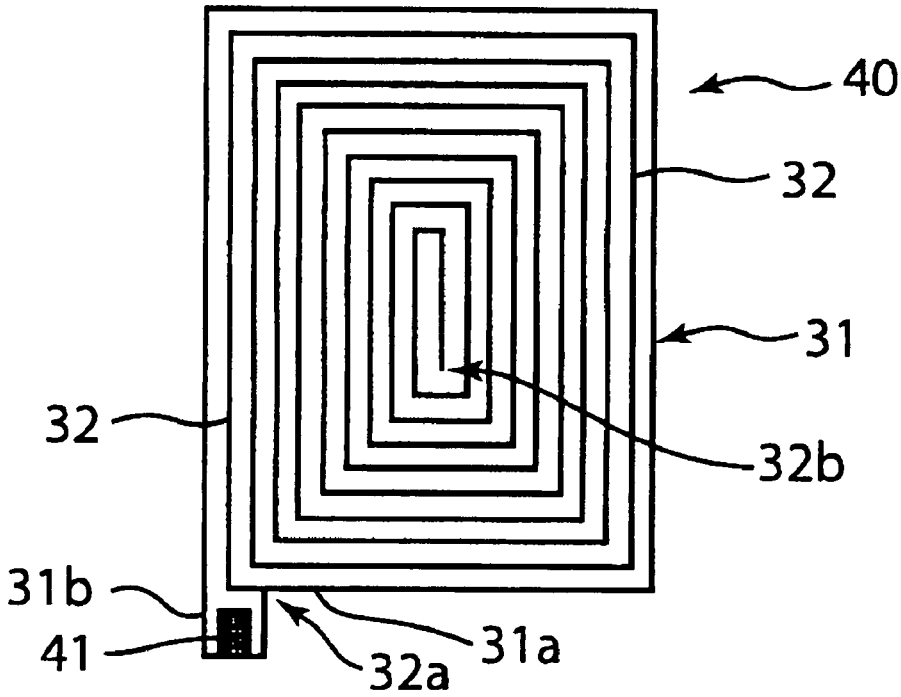
FIG. 32 is a plan view showing a first formation pattern of slits.

A transparent antenna 40 shown in FIG. 32 has a rectangular antenna pattern 31, and a slit 32 is formed on the antenna pattern 31.

The slit 32 has starting point 32*a* of the slit at the boundary portion of the lower rim 31*a* of the antenna pattern 31 and a tub 31*b* projected from the lower rim 31*a* and is formed in a spiral state toward the center along the outlines of the antenna pattern 31, and the approximately the center of the antenna pattern 31 is the terminal point 32*b* of the slit 32. In this drawing, reference numeral 41 shows an antenna terminal formed in the tub 31*b*.

Figure 33:
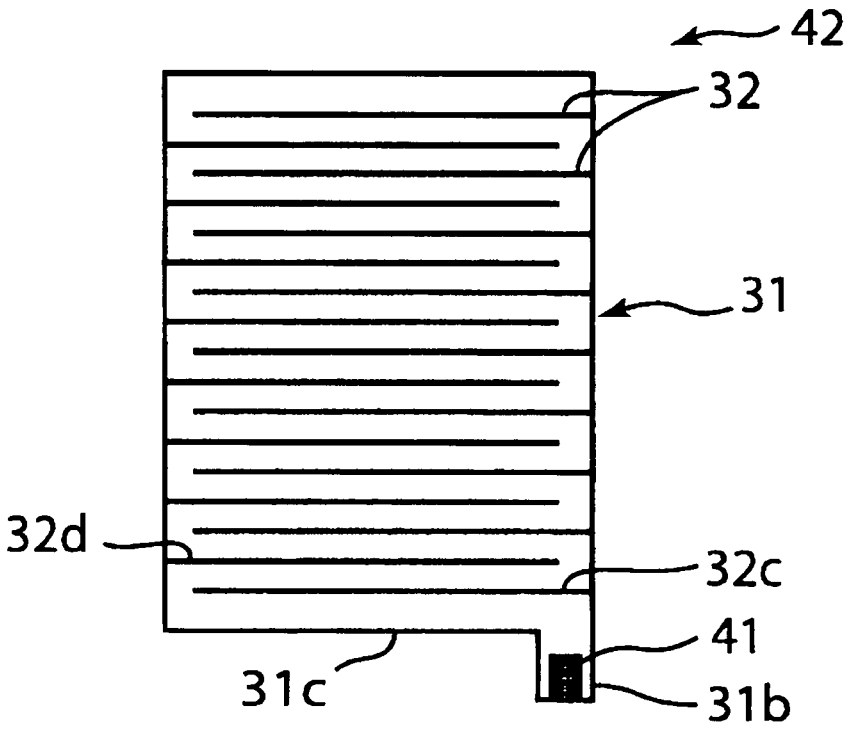
FIG. 33 is a plan view showing a second formation pattern of slits.

A transparent antenna 42 shown in FIG. 33 has a rectangular antenna pattern 31, and slits 32 are formed on the antenna pattern 31. Hereinafter, the same symbols are assigned for the same components as those in FIG. 32 and their explanations will be omitted in the following description.

A plurality of slits 32 are formed in parallel to the shorter side 31*c* of the antenna pattern 31 and among a plurality of the slits 32, slits 32*c* are formed with a slightly shorter length than the shorter side 31*c* from the right rim of the antenna pattern 31 and slits 32*d* are formed also with a slightly shorter length than the shorter side 31*c* from the left rim of the antenna pattern 31. The slits 32 are formed by alternately arranging the slits 32*c* and the slits 32*d* in the vertical direction and, accordingly, the antenna pattern 31 snaking in the vertical direction is formed.

Figure 34:
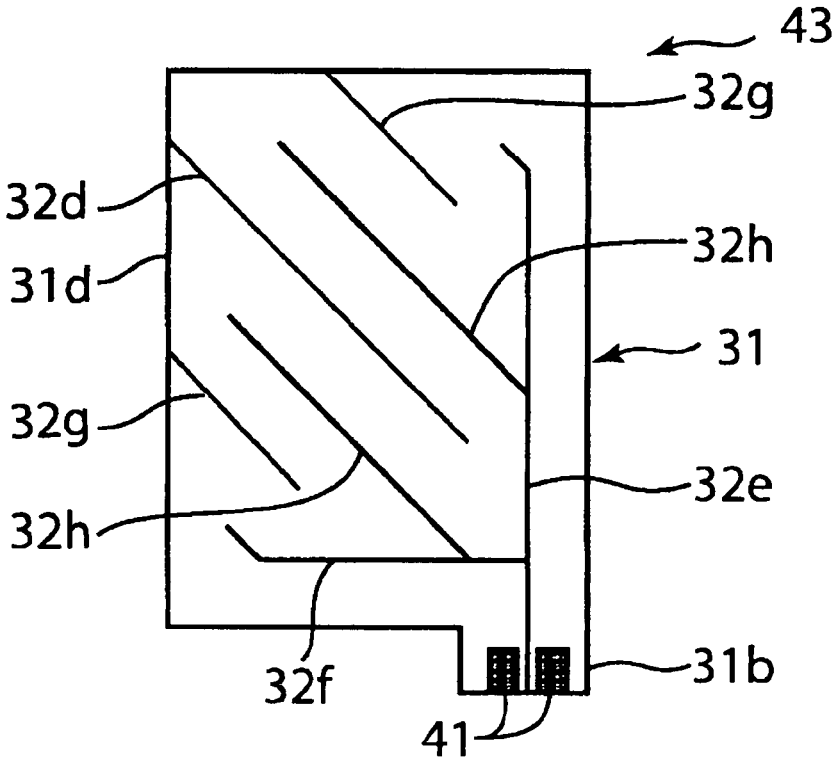
FIG. 34 is a plan view showing a third formation pattern of slits.

A transparent antenna 43 shown in FIG. 34 has a rectangular antenna pattern 31 and provided with slits 32*e* extended in the vertical direction from the center of the tub 31*b* in the tub width direction, slits 32*f* branched in the transverse direction from the middle of the slits 32*e*, and a plurality of slits 32*g* and 32*h* formed slantingly in a parallel state.

The slits 32*g* are formed by cutting from the lower rim of the antenna pattern 31 and are formed in a prescribed length without crossing the slits 32*e* and 32*f*. On the other hand, the slits 32*h* are formed by cutting from the slits 32*e* or 32*f* and are formed in a prescribed length without reaching the left rim 31*d* of the antenna pattern 31. Accordingly, the slantingly snaked antenna pattern 31 is formed within a range surrounded with the slits 32*e* and 32*f*.

Figure 35:
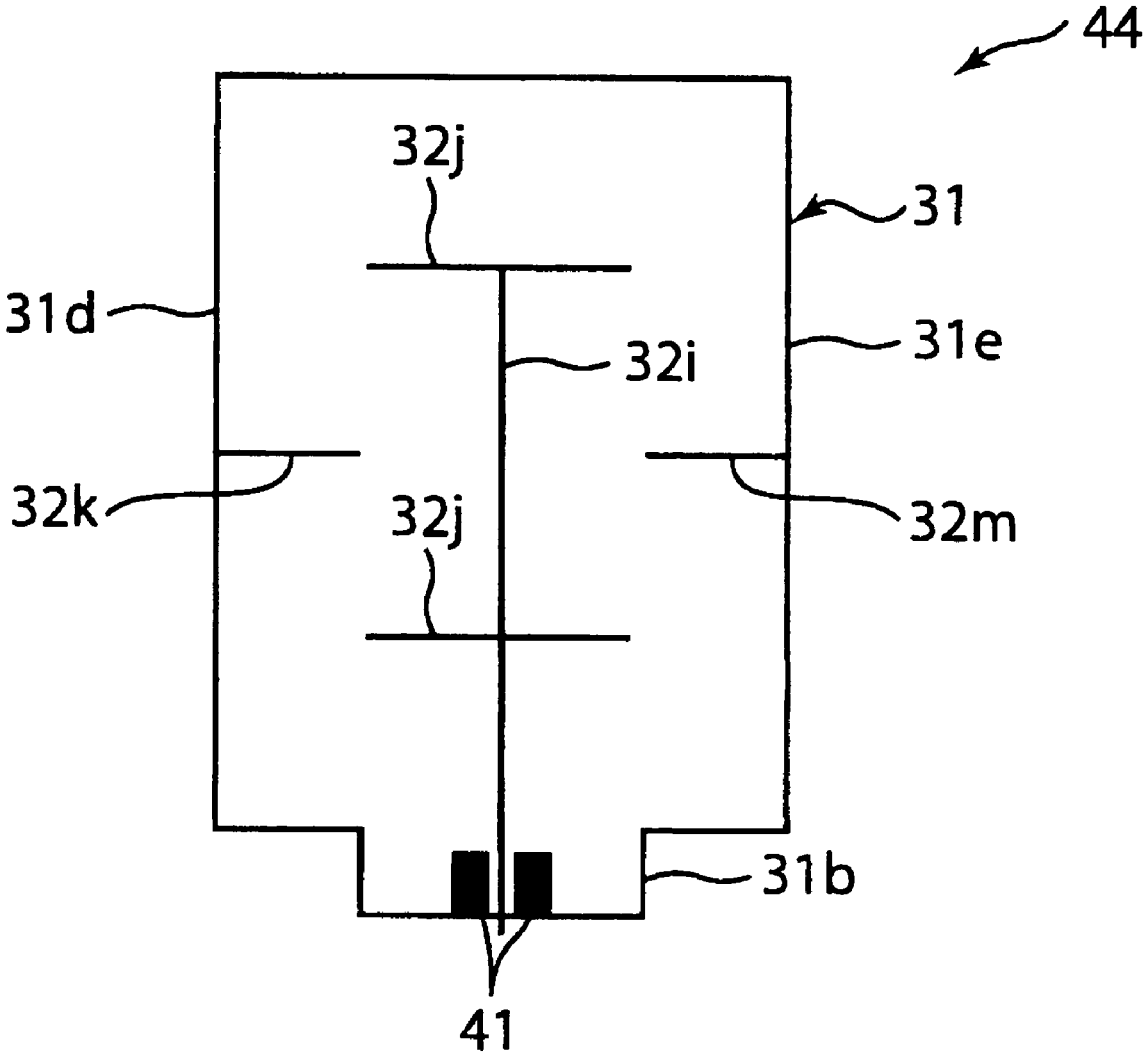
FIG. 35 is a plan view showing a fourth formation pattern of slits.

A transparent antenna 44 shown in FIG. 35 has a rectangular antenna pattern 31 and is provided with a slit 32*i* extended in a prescribed length from the center of the tub 31*b* in the tub width direction of the tub 31*b*, a plurality of slits 32' and 32*j* at right angles to the slit 32*i*, a slit 32*k* formed by cutting in a prescribed length from the left rim 31*d* of the antenna pattern 31, and a slit 32*m* formed by cutting in a prescribed length from the right rim 31*e*.

Accordingly, antenna pattern 31 snaked in a left half and a right half of that the antenna pattern 31 are formed while having the slit 32*i* as the boundary.

Figure 36:
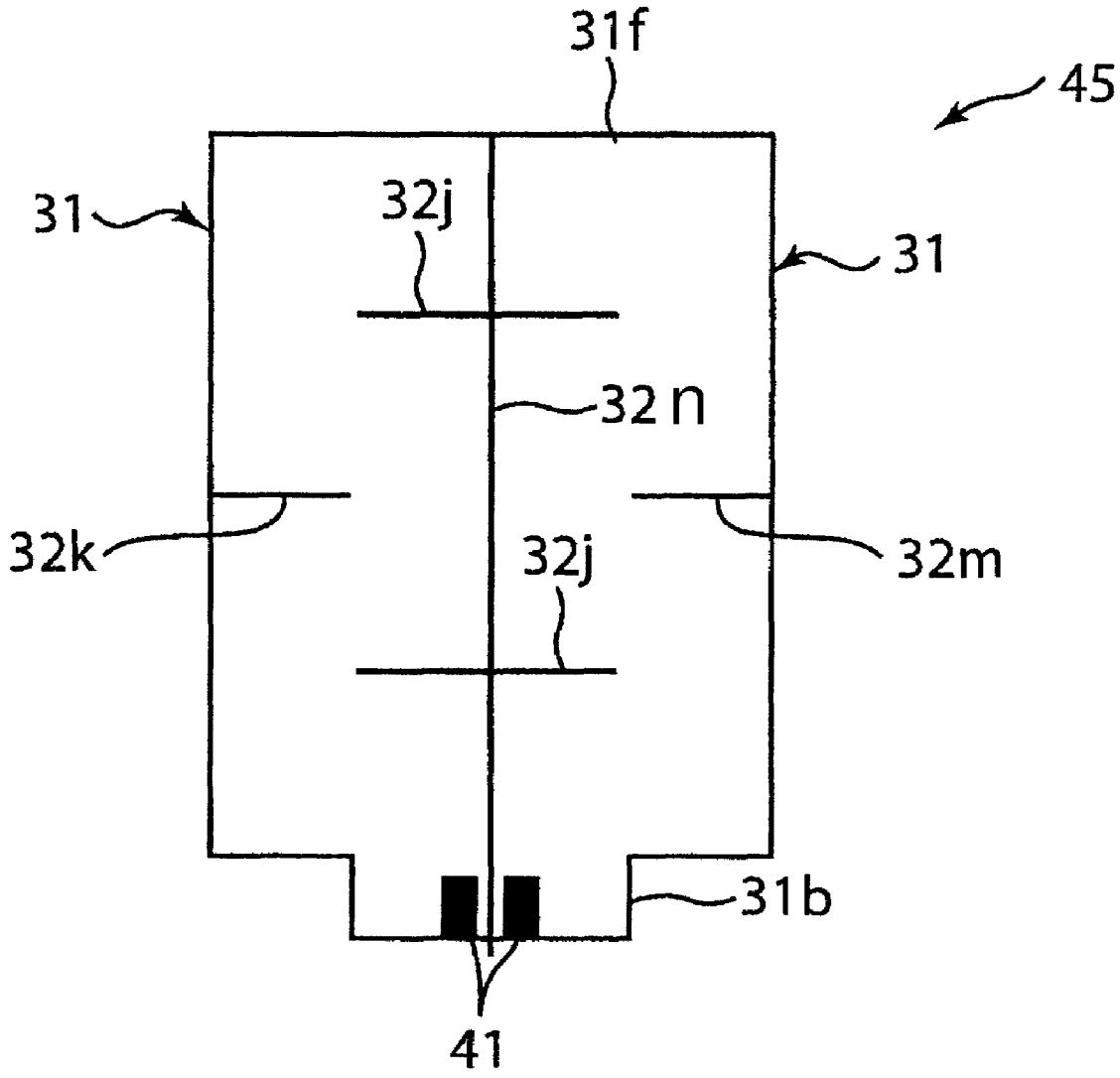
FIG. 36 is a plan view showing a fifth formation pattern of slits.

A transparent antenna 45 shown in FIG. 36 has a rectangular antenna pattern 31 and the point of the antenna pattern that is different from that antenna pattern shown in FIG. 35 is that the slit 32*n* formed in place of the slit 32*i* is extended to the upper rim 31*f* of the antenna pattern 31.

As described, since the antenna pattern 31 is divided between right and left by the slit 32 *n*, these two antenna patterns 31, 31 are arranged adjacently and compose the transparent antenna.

The transparent antenna of the present invention can be installed to the front glass of automobiles, buses, trucks, or the like. Further, it can be installed to the glass of cabins of construction machinery such as hydraulic shovels and clawer cranes. Further, it can also be installed as an antenna for communication to the glass of vehicles of new traffic systems.

The invention claimed is:

1. A transparent antenna for a vehicle, comprising a sheet-like transparent substrate with an electrical isolation and an antenna pattern planarly formed on a surface of the transparent substrate, wherein an electrically conductive section of said antenna pattern is constructed from an electrically conductive thin film of a mesh structure and outlines of each mesh are constructed from extra fine bands having substantially equal width and the width of each of the extra fine bands is 30 mm or less and the light transmittance of said antenna pattern formation section is 70% or higher, wherein said mesh structure is constructed from planar meshes regularly continuous on a plane with the same shape and size and a distinguishing pattern for distinguishing a part of said antenna pattern is formed by adding a pattern linearly in a plurality of meshes or in a bands-like state to a plurality of mesh outlines in a part of said antenna pattern and thereby decreasing the light quantity passing through these meshes to be less than the light quantity passing through said antenna pattern.

2. The transparent antenna for a vehicle according to claim 1, wherein the outlines of the meshes composing said planar meshes as said distinguishing pattern are formed to be thick bands.

3. The transparent antenna for a vehicle according to claim 1, wherein said distinguishing pattern is formed by shifting a part of the mesh pattern of said mesh structure on said antenna pattern within a range not exceeding the size of a single mesh and superposing the mesh pattern on said antenna pattern.

4. The transparent antenna for a vehicle according to claim 1, wherein said distinguishing pattern is formed continuously or intermittently on said antenna pattern and accordingly forming letters and designs on said antenna pattern.

5. A transparent antenna for a vehicle, comprising a sheet-like transparent substrate with an electrical isolation and an antenna pattern planarly formed on a surface of the transparent substrate, wherein an electrically conductive section of said antenna pattern is constructed from an electrically conductive thin film of a mesh structure and outlines of each mesh are constructed from extra fine bands having substantially equal width and the width of each mesh are constructed bands is 30 mm or less and the light transmittance of said antenna pattern formation section is 70% or higher, wherein said mesh structure is constructed from regularly continuous planar meshes on a plane and a gradation section for decreasing luminance difference between said antenna pattern and an antenna pattern non-formation section on said transparent substrate is formed in the boundary region of said antenna pattern and the antenna pattern non-formation section of said transparent substrate.

6. The transparent antenna for a vehicle according to claim 5, wherein said gradation section is formed by partially eliminating the mesh outlines of said antenna pattern in said boundary region or coarsening the meshes.

7. The transparent antenna for a vehicle according to claim 5, wherein said gradation section is formed by making the length of said eliminated outlines of said meshes or the aperture width of said meshes longer step by step from said antenna pattern side to said antenna pattern non-formation section side.

8. The transparent antenna for a vehicle according to claim 5, wherein said mesh structure is composed by arranging a vertical direction electrically conductive wire and a transverse direction electrically conductive wire in a lattice-like state and said gradation section is formed by eliminating a part of at least one of the vertical direction electrically conductive wire and transverse direction electrically conductive wire or widening the intervals of the electrically conductive wire from said antenna pattern side to said antenna pattern non-formation section side.

9. A transparent antenna for a vehicle, comprising a sheet-like transparent substrate with an electrical isolation and an antenna pattern planarly formed on a surface of the transparent substrate, wherein an electrically conductive section of said antenna pattern is constructed from an electrically conductive thin film of a mesh structure and outlines of each mesh are constructed from extra fine bands having substantially equal width and the width of each of the extra fine bands is 30 mm or less and the light transmittance of said antenna pattern formation section is 70% or higher, wherein said antenna pattern is formed in a continuous band-like state by forming slits in a part of said mesh structure and the width of said slits is adjusted not to exceed the maximum size of the mesh size, and wherein one slit is formed spirally toward the center of said mesh structure.

* * * * *

UNITED STATES PATENT AND TRADEMARK OFFICE

CERTIFICATE OF CORRECTION

PATENT NO. : 7,656,357 B2
APPLICATION NO. : 11/887161
DATED : February 2, 2010
INVENTOR(S) : Tatsuo Ishibashi et al.

It is certified that error appears in the above-identified patent and that said Letters Patent is hereby corrected as shown below:

In claim 1, line 9 (column 21, line 28), "mm or less" should read --μm or less--;

In claim 5, line 9 (column 22, line 7), "30mm or less" should read --30μm or less--; and In claim 9, line 9 (column 22, line 44), "mm or less" should read --μm or less--.

Signed and Sealed this

Fifteenth Day of June, 2010

David J. Kappos

David J. Kappos
*Director of the United States Patent and Trademark Office*